US012540607B2

(12) United States Patent
Hunter et al.

(10) Patent No.: US 12,540,607 B2
(45) Date of Patent: Feb. 3, 2026

(54) HYBRID DRIVE AND DISTRIBUTED POWER SYSTEMS FOR WELL STIMULATION OPERATIONS

(71) Applicant: Halliburton Energy Services, Inc., Houston, TX (US)

(72) Inventors: Timothy Holiman Hunter, Duncan, OK (US); Austin Carl Schaffner, Duncan, OK (US); Billy D. Coskrey, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 82 days.

(21) Appl. No.: 18/213,693

(22) Filed: Jun. 23, 2023

(65) Prior Publication Data

US 2024/0426200 A1 Dec. 26, 2024

(51) Int. Cl.
*F04B 17/06* (2006.01)
*F04B 17/03* (2006.01)
*F04B 17/05* (2006.01)

(52) U.S. Cl.
CPC ..... *F04B 17/06* (2013.01); *F04B 17/03* (2013.01); *F04B 17/05* (2013.01)

(58) Field of Classification Search
CPC ..... F04B 17/06; F04B 17/03; F04B 17/05
See application file for complete search history.

(56) References Cited

U.S. PATENT DOCUMENTS 2,208,568 A 7/1940 Benedek
2,634,682 A 4/1953 Huber
2,775,204 A 12/1956 Batten
3,030,829 A 4/1962 Gordon
3,291,234 A 12/1966 Woodburn
3,381,943 A 5/1968 Miller
3,591,147 A 7/1971 Anderson
3,764,233 A 10/1973 Strickland
3,773,438 A 11/1973 Hall
3,792,790 A 2/1974 Brubaker
(Continued)

FOREIGN PATENT DOCUMENTS

CA 2773843 C 1/2016
CA 2707269 C 8/2018
(Continued)

OTHER PUBLICATIONS

Examiner's Letter issued in related Canadian application No. 3,030,829, dated Feb. 10, 2020, 5 pages.
(Continued)

*Primary Examiner* — Bryan M Lettman
(74) *Attorney, Agent, or Firm* — Conley Rose, P.C.; Rodney B. Carroll

(57) ABSTRACT

A hybrid drive system that uses multiple sources of mechanical energy to drive an oilfield apparatus is provided. The hybrid drive system may include a first mover for generating first mechanical energy, the oilfield apparatus, a drivetrain for providing first mechanical energy from the first mover to the oilfield apparatus, and a second mover to generate and provide second mechanical energy to the oilfield apparatus. The second mover comprises an electric motor/generator. The second mover can, at times, be operable to provide excess power that can be used elsewhere at the wellsite.

20 Claims, 5 Drawing Sheets

(56) References Cited

U.S. PATENT DOCUMENTS 3,891,354 A 6/1975 Bosch
3,893,655 A 7/1975 Sandiford
3,931,999 A 1/1976 McCain
3,961,562 A 6/1976 Kersten
3,985,472 A 10/1976 Virtue
4,159,623 A 7/1979 McReynolds
4,265,266 A 5/1981 Kierbow
4,272,224 A 6/1981 Kabele
4,341,508 A 7/1982 Rambin, Jr.
4,470,771 A 9/1984 Hall
4,504,296 A 3/1985 Newton
4,563,553 A 1/1986 Wilson
4,568,836 A 2/1986 Reenberg
4,701,095 A 10/1987 Berryman
4,730,118 A 3/1988 Quarles
4,850,750 A 7/1989 Cogbill
4,854,714 A 8/1989 Davis
5,127,450 A 7/1992 Saatkamp
5,165,862 A 11/1992 Lindblom
5,181,837 A 1/1993 Niemiec
5,261,796 A 11/1993 Niemiec
5,318,382 A 6/1994 Cahill
5,320,501 A 6/1994 Langosch
5,422,550 A 6/1995 McClanahan
5,439,066 A 8/1995 Gipson
5,452,954 A 9/1995 Handke
5,465,798 A 11/1995 Edlund
5,606,853 A 3/1997 Birch
5,752,768 A 5/1998 Assh
5,775,881 A 7/1998 Stich
5,819,848 A 10/1998 Rasmuson
5,865,247 A 2/1999 Paterson
5,923,136 A 7/1999 Baerd
5,941,105 A 8/1999 Macey
5,941,305 A 8/1999 Thrasher
6,002,063 A 12/1999 Bilak
6,059,539 A 5/2000 Nyilas
6,167,965 B1 1/2001 Bearden
6,321,860 B1 11/2001 Reddoch
6,375,436 B1 4/2002 Irie
6,414,455 B1 7/2002 Watson
6,634,173 B2 10/2003 Linster
6,640,912 B2 11/2003 Reddoch
6,771,218 B1 8/2004 Lalezari
6,773,238 B1 8/2004 Sprakel
6,952,929 B2 10/2005 Inoue
7,124,589 B2 10/2006 Neary
7,173,399 B2 2/2007 Sihler
7,245,033 B2 7/2007 Wurtele
7,353,875 B2 4/2008 Stephenson
7,451,812 B2 11/2008 Cooper
7,619,324 B2 11/2009 Folken
7,640,738 B1 1/2010 Hauser
7,690,198 B2 4/2010 Rousseau
7,717,193 B2 5/2010 Egilsson
7,836,949 B2 11/2010 Dykstra
7,841,394 B2 11/2010 McNeel
7,845,413 B2 12/2010 Shampine
7,931,082 B2 4/2011 Surjaatmadja
7,949,483 B2 5/2011 Discenzo
8,146,665 B2 4/2012 Neal
8,282,823 B2 10/2012 Acernese
8,339,090 B2 12/2012 Van Spengen
8,444,312 B2 5/2013 Hagan
8,456,116 B2 6/2013 Burdick
8,503,180 B2 8/2013 Nojima
8,506,267 B2 8/2013 Gambier
8,523,533 B1 9/2013 Best
8,564,233 B2 10/2013 Kidd
8,590,614 B2 11/2013 Surjaatmadja
8,668,465 B2 3/2014 Wadsley
8,789,601 B2 7/2014 Broussard
8,794,307 B2 8/2014 Coquilleau
8,801,407 B2 8/2014 Simpson
8,874,393 B2 10/2014 Nagai
8,997,904 B2 4/2015 Cryer
9,016,383 B2 4/2015 Shampine
9,103,193 B2 8/2015 Coli
9,121,257 B2 9/2015 Coli
9,121,402 B2 9/2015 Marshall
9,140,110 B2 9/2015 Coli
9,188,114 B2 11/2015 Kuttler
9,316,216 B1 4/2016 Cook
9,366,114 B2 6/2016 Coli
9,395,049 B2 7/2016 Vicknair
9,410,410 B2 8/2016 Broussard
9,534,473 B2 1/2017 Morris
9,579,980 B2 2/2017 Cryer
9,611,728 B2 4/2017 Oehring
9,650,871 B2 5/2017 Oehring
9,650,879 B2 5/2017 Broussard
9,745,840 B2 8/2017 Oehring
9,840,901 B2 12/2017 Oehring
9,850,422 B2 12/2017 Lestz
9,893,500 B2 2/2018 Oehring
9,915,129 B2 3/2018 Newell
9,945,365 B2 4/2018 Hernandez
9,970,278 B2 5/2018 Broussard
9,995,218 B2 6/2018 Oehring
10,020,711 B2 7/2018 Oehring
10,036,238 B2 7/2018 Oehring
10,119,380 B2 11/2018 Joseph
10,119,381 B2 11/2018 Oehring
10,232,332 B2 3/2019 Oehring
10,254,732 B2 4/2019 Oehring
10,337,308 B2 7/2019 Broussard
10,662,765 B2 5/2020 Ferguson
11,421,673 B2 8/2022 Coskrey
11,808,127 B2 11/2023 Coskrey
11,913,316 B2 2/2024 Coskrey
2001/0000996 A1 5/2001 Grimland
2003/0057704 A1 3/2003 Baten
2003/0161212 A1 8/2003 Neal
2003/0170077 A1 9/2003 Herd
2004/0008571 A1 1/2004 Coody
2005/0116541 A1 6/2005 Seiver
2006/0007775 A1 1/2006 Dean
2006/0168955 A1 8/2006 Longfield
2007/0078614 A1 4/2007 Discenzo
2007/0125543 A1 6/2007 McNeel
2007/0125544 A1 6/2007 Robinson
2007/0201305 A1 8/2007 Heilman
2007/0269317 A1 11/2007 Clancy
2007/0277982 A1 12/2007 Shampine
2008/0017369 A1 1/2008 Sarada
2008/0029267 A1 2/2008 Shampine
2008/0066911 A1 3/2008 Luharuka
2008/0131295 A1 6/2008 Koehl
2008/0135238 A1 6/2008 Cugnet
2008/0164021 A1 7/2008 Dykstra
2008/0165612 A1 7/2008 Dykstra
2008/0165613 A1 7/2008 Dykstra
2008/0203734 A1 8/2008 Grimes
2008/0236818 A1 10/2008 Dykstra
2008/0264641 A1 10/2008 Slabaugh
2008/0314807 A1 12/2008 Junghanns
2009/0068031 A1 3/2009 Gambier
2009/0090504 A1 4/2009 Weightman
2009/0101410 A1 4/2009 Egilsson
2009/0120635 A1 5/2009 Neal
2009/0178387 A1 7/2009 Schultz
2009/0260826 A1 10/2009 Sherwood
2009/0261599 A1 10/2009 Alston
2009/0308602 A1 12/2009 Bruins
2009/0312885 A1 12/2009 Buiel
2010/0038907 A1 2/2010 Hunt
2010/0051272 A1 3/2010 Loree
2010/0054959 A1* 3/2010 Rogers ..... F04B 47/02
417/362
2010/0068071 A1 3/2010 Bowden
2010/0071899 A1 3/2010 Coquilleau
2010/0081649 A9 4/2010 Pfirrmann
2010/0083649 A1 4/2010 Woodmansee
2010/0133901 A1 6/2010 Zhang

(56) References Cited

U.S. PATENT DOCUMENTS

| | | | | |
|---|---|---|---|---|
| 2010/0169030 | A1 | 7/2010 | Parlos | |
| 2010/0231146 | A1 | 9/2010 | Beck | |
| 2010/0263861 | A1 | 10/2010 | Dykstra | |
| 2010/0310384 | A1 | 12/2010 | Stephenson | |
| 2010/0326663 | A1* | 12/2010 | Bobier | F04B 47/00 166/307 |
| 2011/0061855 | A1 | 3/2011 | Case | |
| 2011/0085924 | A1 | 4/2011 | Shampine | |
| 2011/0106122 | A1 | 5/2011 | Cetola | |
| 2011/0148209 | A1 | 6/2011 | Williams | |
| 2011/0197988 | A1 | 8/2011 | Van Vliet | |
| 2011/0268586 | A1 | 11/2011 | Rogers | |
| 2011/0309055 | A1 | 12/2011 | Rozmarynowski | |
| 2012/0001482 | A1 | 1/2012 | Burdick | |
| 2012/0049625 | A1 | 3/2012 | Hopwood | |
| 2012/0073670 | A1 | 3/2012 | Lymberopoulos | |
| 2012/0085541 | A1 | 4/2012 | Love | |
| 2012/0166096 | A1 | 6/2012 | Stephenson | |
| 2012/0205119 | A1 | 8/2012 | Wentworth | |
| 2012/0223524 | A1 | 9/2012 | Williams | |
| 2012/0255734 | A1 | 10/2012 | Coli | |
| 2012/0292992 | A1 | 11/2012 | Williams | |
| 2013/0032540 | A1 | 2/2013 | Acernese | |
| 2013/0045117 | A1 | 2/2013 | Wishart | |
| 2013/0233542 | A1 | 9/2013 | Shampine | |
| 2013/0271083 | A1 | 10/2013 | Williams | |
| 2013/0276430 | A1 | 10/2013 | Ulrich | |
| 2013/0284422 | A1 | 10/2013 | Irvine | |
| 2013/0305851 | A1 | 11/2013 | Rees | |
| 2013/0306322 | A1 | 11/2013 | Sanborn | |
| 2013/0308414 | A1 | 11/2013 | Lucas | |
| 2014/0008074 | A1 | 1/2014 | Nevison | |
| 2014/0048253 | A1 | 2/2014 | Andreychuk | |
| 2014/0096974 | A1 | 4/2014 | Coli | |
| 2014/0130509 | A1 | 5/2014 | Drnevich | |
| 2014/0138079 | A1 | 5/2014 | Broussard | |
| 2014/0147291 | A1 | 5/2014 | Burnette | |
| 2014/0158345 | A1 | 6/2014 | Jang | |
| 2014/0174717 | A1 | 6/2014 | Broussard | |
| 2014/0219824 | A1 | 8/2014 | Burnette | |
| 2014/0223894 | A1 | 8/2014 | Tomter | |
| 2014/0251623 | A1 | 9/2014 | Lestz | |
| 2014/0255214 | A1 | 9/2014 | Burnette | |
| 2014/0261695 | A1 | 9/2014 | Dehring | |
| 2014/0262292 | A1 | 9/2014 | Joseph | |
| 2014/0290768 | A1 | 10/2014 | Randle | |
| 2014/0294599 | A1 | 10/2014 | Wi | |
| 2014/0294603 | A1 | 10/2014 | Best | |
| 2014/0298846 | A1 | 10/2014 | Taras | |
| 2015/0027712 | A1 | 1/2015 | Vicknair | |
| 2015/0078924 | A1 | 3/2015 | Zhang | |
| 2015/0114652 | A1 | 4/2015 | Lestz | |
| 2015/0136043 | A1 | 5/2015 | Shaaban | |
| 2015/0144336 | A1 | 5/2015 | Hardin | |
| 2015/0211512 | A1 | 7/2015 | Wiegman | |
| 2015/0252661 | A1 | 9/2015 | Glass | |
| 2015/0275891 | A1 | 10/2015 | Chong | |
| 2015/0300336 | A1 | 10/2015 | Hernandez | |
| 2015/0322761 | A1 | 11/2015 | Hodgson | |
| 2015/0353816 | A1 | 12/2015 | Thrash | |
| 2015/0354322 | A1 | 12/2015 | Vicknair | |
| 2016/0032691 | A1 | 2/2016 | Richter | |
| 2016/0032703 | A1 | 2/2016 | Broussard | |
| 2016/0055737 | A1 | 2/2016 | Boken | |
| 2016/0105022 | A1 | 4/2016 | Oehring | |
| 2016/0177675 | A1 | 6/2016 | Morris | |
| 2016/0177678 | A1 | 6/2016 | Morris | |
| 2016/0194942 | A1 | 7/2016 | Wiegman | |
| 2016/0208592 | A1 | 7/2016 | Oehring | |
| 2016/0221843 | A1 | 8/2016 | Acernese | |
| 2016/0230525 | A1 | 8/2016 | Lestz | |
| 2016/0258267 | A1 | 9/2016 | Payne | |
| 2016/0281484 | A1 | 9/2016 | Lestz | |
| 2016/0290114 | A1 | 10/2016 | Oehring | |
| 2016/0298425 | A1 | 10/2016 | Thrash | |
| 2016/0312108 | A1 | 10/2016 | Lestz | |
| 2016/0319650 | A1 | 11/2016 | Oehring | |
| 2016/0326854 | A1 | 11/2016 | Broussard | |
| 2016/0348479 | A1 | 12/2016 | Oehring | |
| 2017/0016433 | A1 | 1/2017 | Chong | |
| 2017/0021318 | A1 | 1/2017 | McIver | |
| 2017/0028368 | A1 | 2/2017 | Oehring | |
| 2017/0030177 | A1 | 2/2017 | Oehring | |
| 2017/0107804 | A1 | 4/2017 | Krug | |
| 2017/0114625 | A1 | 4/2017 | Norris | |
| 2017/0226998 | A1 | 8/2017 | Zhang | |
| 2018/0230778 | A1 | 8/2018 | Thrash | |
| 2019/0178235 | A1* | 6/2019 | Coskrey | F04B 17/03 |
| 2022/0260071 | A1 | 8/2022 | Coskrey et al. | |
| 2022/0260072 | A1 | 8/2022 | Coskrey et al. | |
| 2024/0159134 | A1 | 5/2024 | Hunter | |

FOREIGN PATENT DOCUMENTS

| | | | |
|---|---|---|---|
| CN | 1877079 | A | 12/2006 |
| CN | 102602322 | A | 7/2012 |
| CN | 202463670 | U | 10/2012 |
| CN | 202544803 | U | 11/2012 |
| CN | 202560199 | U | 11/2012 |
| DE | 19846940 | A1 | 4/2000 |
| DE | 102005018324 | A1 | 10/2006 |
| EP | 1927750 | A2 | 6/2008 |
| WO | 2001094786 | A1 | 12/2001 |
| WO | 2004107534 | A1 | 12/2004 |
| WO | 2007113528 | A1 | 10/2007 |
| WO | 2010023489 | A1 | 3/2010 |
| WO | 2011138580 | A2 | 11/2011 |
| WO | 2013148342 | A1 | 10/2013 |
| WO | 2014105642 | A1 | 7/2014 |
| WO | 2014177346 | A1 | 11/2014 |
| WO | 2015011223 | A2 | 1/2015 |

OTHER PUBLICATIONS

Examination Report issued in related Canadian Patent Application No. 3,030,829 dated Oct. 8, 2021, 4 pages.

International Search Report and Written Opinion issued in related PCT Application No. PCT/US2016/050196 dated May 26, 2017, 15 pages.

International Search Report and Written Opinion issued in PCT/GB2011/000678 dated Oct. 12, 2012, 11 pages.

International Search Report in PCT/GB2010/001717 dated May 10, 2011, 4 pages.

Black Diamond Claim Chart for U.S. Pat. No. 9,410,410, *US. Well Services, LLC* v. *TOPS Well Services, LLC et al.*, Case 3:19-cv-00237, Document 76-11 (S.D. Tex.), Apr. 29, 2020, 31 pages.

U.S. Well Services, "Game-changing hydraulic fracturing technology, reduces emi•• sions by 99%," Globe Newswire, Oct. 1, 2014, 2 pages.

"Evolution Well Services Advances Fracturing Operations with a Electrically Powered System," News Provided by Evolution Well Services, Jun. 4, 2012, 1 page.

Hausfeld, et al., "TM2500+ Power for Hydraulic Fracturing," 20th Symposium of the Industrial Application of Gas Turbines Commit• tee (13-IAGT-203), Banff, Alberta, Canada, Oct. 2013, 9 pages.

Brenner, Noah, "Dual fuel a nimble approach," Feb. 21, 2013, 1 page.

"Field Gas Becomes Fuel Source for Pumps at Drillsite," HartEnergy Newsletter, Sep. 17, 2013, 3 pages.

"Green Field Energy Services and GE signs natural gas poweredequipment agreement," LNG Processing Technology, Jan. 7, 2013, 9 pages, https://www.hydrocarbons-technology.com/uncategorised/newsgreen-field-energy-services-and-ge-signs-natural-gas-powered• equipment -agreement/.

"Green Field Energy Services Conducts First-Ever Frac Pump Test Powered 100% by Field Gas," News Provided by Green Field Energy Services, PRNewswire, Jan. 3, 2013, 2 pages.

Spencer, Malia, "Green Field Energy Services lands in Monessen, "Pittsburgh Business Times, Aug. 7, 2013, 7 pages, https://www.bizjournals.com/pittsburgh/blog/energy/2013/08/green-field-energy• services-lands-in-html.

(56) References Cited

OTHER PUBLICATIONS

United States Securities and Exchange Commission, Form S-4 for Green Field Energy Services, Inc., Hub City Tools, Inc. filed May 11, 2012, 206 pages, https://www.sec.gov.archives/edgar/data/ 1542387/000 I 19312512228720/d349756ds5.htm.
Spencer, Malia, "Marcellus gas used to power come frack jobs,"Pittsburgh Business Times, Jul. 2013, 9 pages, https://www.bizjoumals. com/pittsburgh/blog/energy/2013/07/marcellus-gas-used-to-power• frack-some.html.
Shauk, Zain, "Military copters recycled for fracking," SFGate, Jun. 1, 2013, 13 pages, https://www.sfgate.com/business/article/militar•• copters-recycled-for-fracking-4568836.php.
Shauk, Zain, "Redeployment: Battlefield engines take an oil field mission," Houston Chronicle, May 30, 2013, 10 pages, https://www.houstonchroni cle.com/business/energy/article/Redeployment•Battlefield-engines-take-on-oil-4563553.php.
"Turbine Frac Units," WMD Squared, 2012, 5 pages, https:/wmdsquared.com/work/gfes-turbine-frac-units/.
Boman, Karen, "Turbine Technology Powers Green Field Multi•Fuel Frack Pump," Rigzone, Mar. 7, 2013, 9 pages, https://www. rigzone.com/news/oil_gas/a/124883/turbine_technology_powers_ green_field_multifuel_frack_pump/.
"USA: Green Field Energy, GE Ink Deal on Gas Powered Equi•• ment," Offshore Energy, Jan. 8, 2013, 4 pages, https://www.offshore• energy.biz/usa-green-field-energy-ge-ink-deal-on-gas-powere•• equipment/.
Excerpts related to E-Powered Grizzly and E-Drive HT-400 pumps, Halliburton, admitted as prior art, 6 pages.
Excerpts from Equipment Data Report, Halliburton Energy Services, Duncan, OK, Mar. 23, 2012, 2 pages.
Excerpts from Project Comprehensive Study Report, Sep. 2011, 2 pages.
Efficient and environmental solutions commercialized shale gas exploitation in Sichuan Basin, Honghua Group, 35 pages, www.hh•gltd.com.
Owen, Charlotte, "Chinese company launches new fracking rigs,"Oil & Gas Technology, May 2, 2012, 2 pages, www. bilandgastechnology.net/upstream-news/chinese-company-launches• new-fracking-rigs.
Honghua Group Ltd. Manual, Jun. 2014, 42 pages, www.hh-gltd.com.HHF-1600 Mud Pump, HongHua America, Inc., 5 pages, www.hh• amenca.com.
"Honghua Group Limited, Honghua: hh (honghua) Showcases Offshore and Land Drilling Technology Along with Shale Gas Solutions at the 2014 Offshore Technology Conference," May 6, 2014, 4 pages.
Scott, Katherine, "Honghua developing new-generation shal•• drilling rig, plans testing of frac pump," Drilling Contractor, May 23, 2013, 3 pages, https://www.drillingcontractor.org/honghua• developing-new-generation-shale-drilling-rig-plans-testing-of-frac• pump-23278.
"Honghua Group and Baker Hughes Collaborate to Explore and Develop China's Unconventional Hydrocarbons Market," Honghua Group Limited, Dec. 12, 2012, 2 pages.
"Honghua Group Introduces 6,000-hp integrated shale gas system," Drilling Contractor, May 21, 2012, 3 pages, https://www. drillingcontractor.org/honghua-introduces-6,000-hp-integrated-shale• gas-system.
Honghua Group Limited, 2013 Annual Report, 192 pages. "Honghua Group Showcases Shale Gas, Offshore and Land Drilling Solutions at the 2013 Offshore Technology Conference," BusinessWire, May 6, 2013, 2 pages.
AP Alert-Energy, "Honghua Group to Launch Integrated Shale Gas Exploitation Solution at OTC 2012,", May 1, 2012, 4 pages.
Johnson, Luke, "Honghua unveils natgas-powered drill system," EPaper-Upstrearn Online, May 3, 2012, 2 pages.
Honghua America, LLC, Rig Equipment, 2011, 1 page, http://web.archive.org/web/20110205080538/http://www.hh-arnerica.com:80/webfront/rig-equipment/.
Kever, Jeannie, OTC attendance zips past 100,000, Houston Chronicle, May 9, 2013, 8 pages, https://www.houstonchronicle.com/business/energylconferences/artide/OTC-attendance-zips-past-100-000- 4504296.php.
Efficient and environmental solutions commercialized shale gas exploitation in Sichuan Basin, Honghua Group, available at least as of Sep. 18, 2015, 35 pages, www.hh-gltd.com.
Honghua America, Inc., HHF-1600 Mud Pump, available at least as of Aug. 12, 2011, 5 pages, www.hh-arnerica.com.
1966 Halliburton Sales and Service Catalog, 3 pages.
Excerpts from manual related to Halliburton Stim Star vessel, admitted as prior art, 7 pages.
"The Jet Frac Revolution," Turbine Stimulation Technologies, BIC Magazine, Apr. 2006, 3 pages.
Archive of MTT Website, available at https://web.archive.org/web/20090615185330/marineturbine.corn/frac.asp, Jun. 15, 2009, 3 pages.
Invalidity Chart, Mud Pump and Associated Materials HHUS Sold to Nabors, *US. Well Services, LLC* v. *TOPS Well Services, LLC et al.*, Case 3:19-cv-00237, D.I. 76-13 (S.D. Tex.), Apr. 29, 2020, 135 pages.
Stim Bar (Brasil) General Arrangement Drawing, Halliburton Energy Services, Inc., Dec. 6, 2013, 1 page.
New Simulation Vessel Service Proposal, Halliburton, Sep. 8, 2010, 7 pages.
Halliburton Stim Star vessel, Halliburton, available at least as of 2003, 7 pages.

* cited by examiner

HYBRID DRIVE AND DISTRIBUTED POWER SYSTEMS FOR WELL STIMULATION OPERATIONS

TECHNICAL FIELD

The present disclosure relates generally to treatment operations for hydrocarbon wells, and more particularly, to hybrid drive and energy distribution systems for oilfield (e.g., well stimulation) operations.

BACKGROUND

Hydrocarbons, such as oil and gas, are commonly obtained from subterranean formations that may be located onshore or offshore. The development of subterranean operations and the processes involved in removing hydrocarbons from a subterranean formation are complex. Subterranean operations involve a number of different steps such as, for example, drilling a wellbore at a desired wellsite, treating and stimulating the wellbore to optimize production of hydrocarbons, and performing the necessary steps to produce and process the hydrocarbons from the subterranean formation.

Treating and stimulating a wellbore can include, among other things, delivering various fluids (along with additives, proppants, gels, cement, etc.) to the wellbore under pressure and injecting those fluids into the wellbore. One example treatment and stimulation operation is a hydraulic fracturing operation in which the fluids are highly pressurized via pumping systems to create fractures in the subterranean formation. The pumping systems typically include high-pressure, reciprocating pumps driven through conventional transmissions by diesel engines, which are used due to their ability to provide high torque to the pumps. Over the course of a fracturing operation, however, the diesel engines may consume thousands of gallons of diesel fuel, which is expensive and can be difficult to supply in sufficient quantities in a wellsite.

BRIEF SUMMARY OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
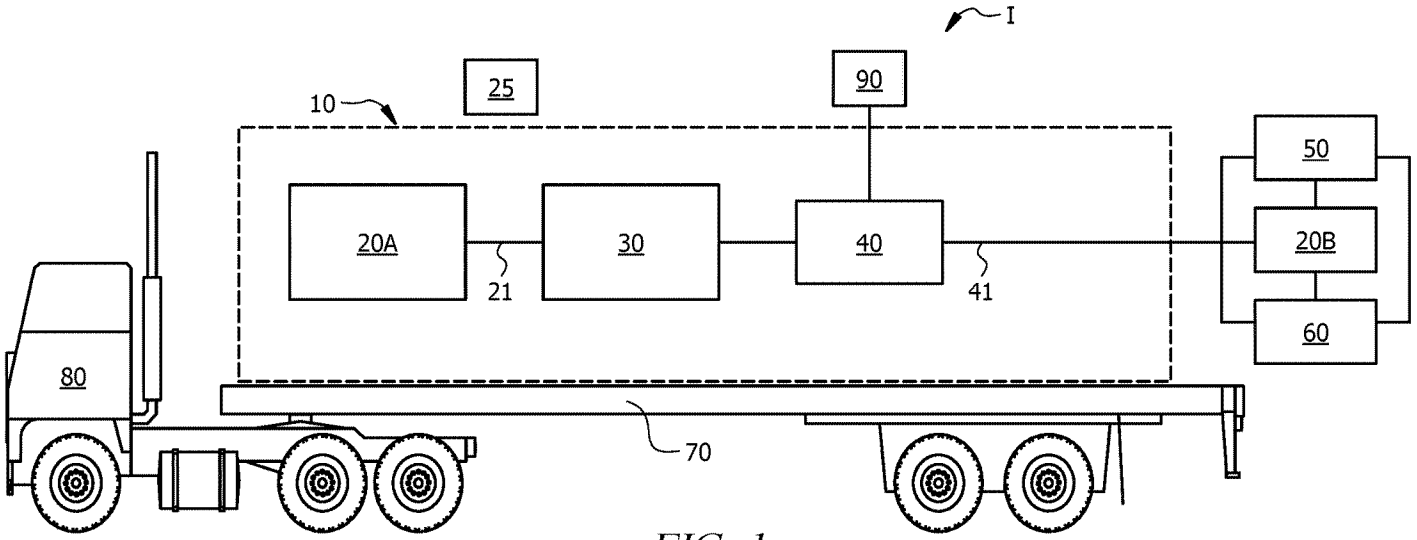
FIG. 1 is a diagram illustrating an example apparatus, according to aspects of the present disclosure.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

The terms "couple" or "couples" as used herein are intended to mean either an indirect or a direct connection. Thus, if a first device or component couples to a second device or component, that connection may be through a direct connection, or through an indirect mechanical or electrical connection via other devices or components and connections. The term "fluidically coupled" or "in fluid communication" as used herein is intended to mean that there is either a direct or an indirect fluid flow path between two devices or components.

Arrows in the figures can indicate flow in one direction, although, in instances flow in the other direction is also possible. For example, flow of electricity 41 to or from one hybrid unit 10 to another or vice versa. For simplicity, as flow can, in embodiments, be in both directions between various components described herein, arrows have not utilized in most of the drawings.

The present disclosure is directed to a hybrid drive and distribution system or apparatus (also referred to simply herein as a "system" or "apparatus") that uses multiple sources of mechanical energy to drive a piece of oilfield equipment (also referred to herein as a hybrid unit oilfield apparatus or "oilfield apparatus") and can, at times, provide excess power that can be utilized elsewhere at a wellsite. The multiple sources of mechanical energy may provide flexibility with respect to system design and allow for alternative sources of fuel and energy to be used to drive on-site oilfield equipment (e.g., pumping) systems. Via the herein disclosed system and method, excess power can be stored, synchronized, and/or utilized directly to power other devices on-site. This may reduce the total hydrocarbon (e.g., diesel) fuel consumption utilized to perform a wellbore (e.g., a stimulation) operation. In embodiments, configurations of the apparatus of this disclosure can enable one or more diesel engines to be entirely excluded from the wellbore servicing (e.g., pumping) process in favor of alternative mechanical energy sources, such as spark-ignited natural gas engines, that typically do not have sufficient torque capacity to power certain oilfield apparatus (e.g., a well stimulation pump). Additionally, the use of a second source of mechanical energy may increase the useful life of wellbore (e.g., pumping) systems by providing a second system that can account for the reduced output torque that is characteristic of aging engines and motors.

Figure 2:
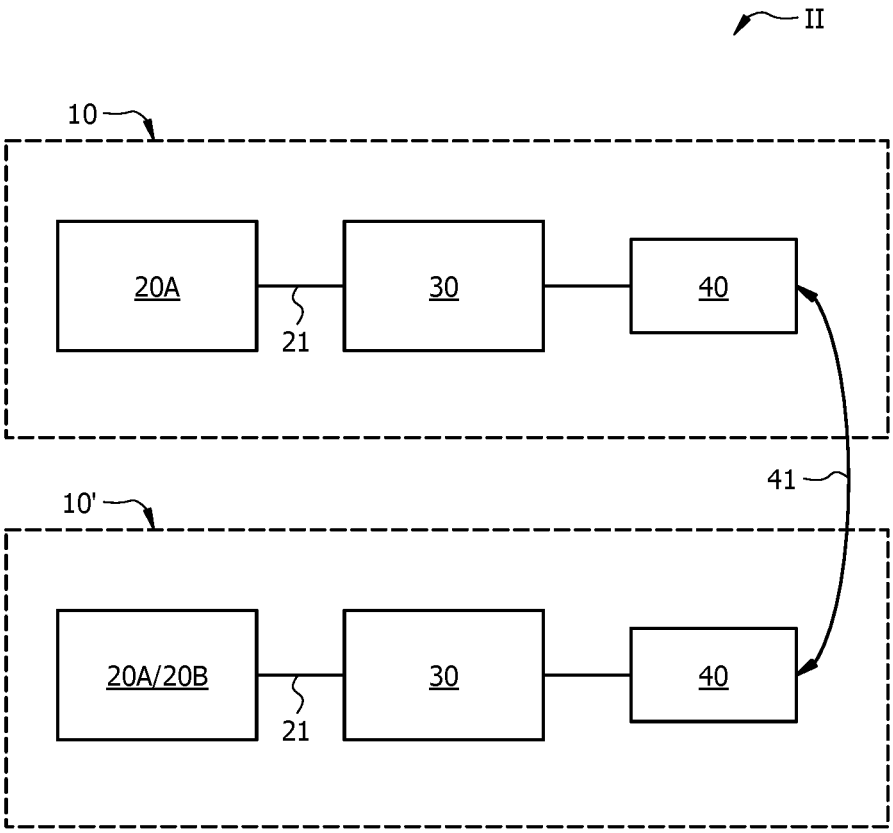
FIG. 2 is a diagram illustrating another example apparatus, according to aspects of the present disclosure.
Figure 3:
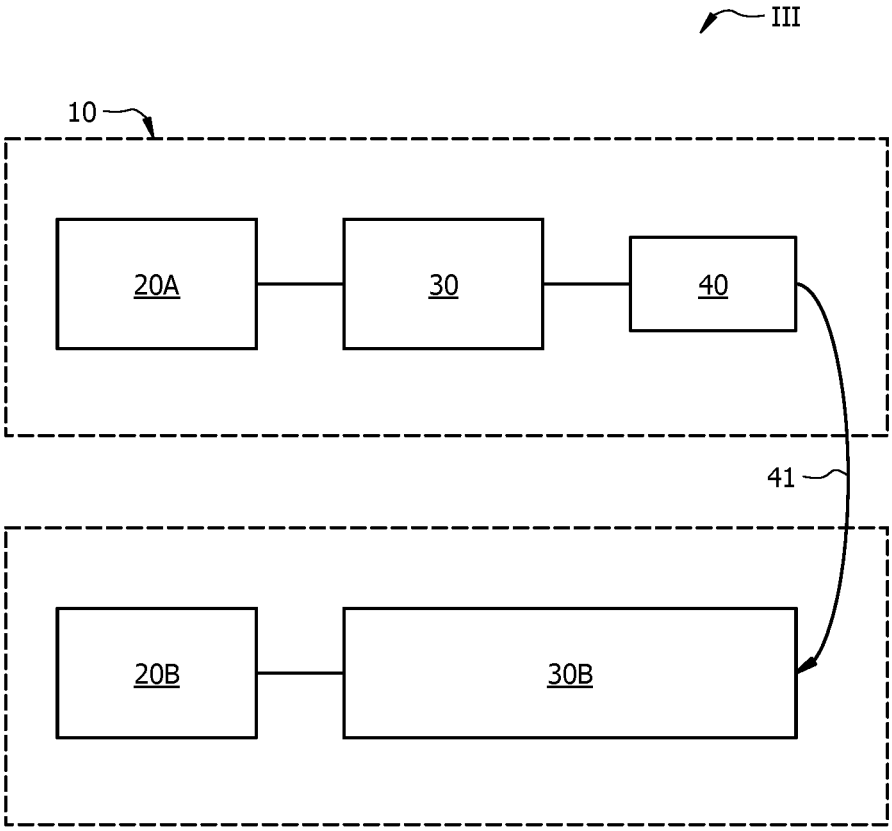
FIG. 3 is a diagram illustrating another example apparatus, according to aspects of the present disclosure.
Figure 4:
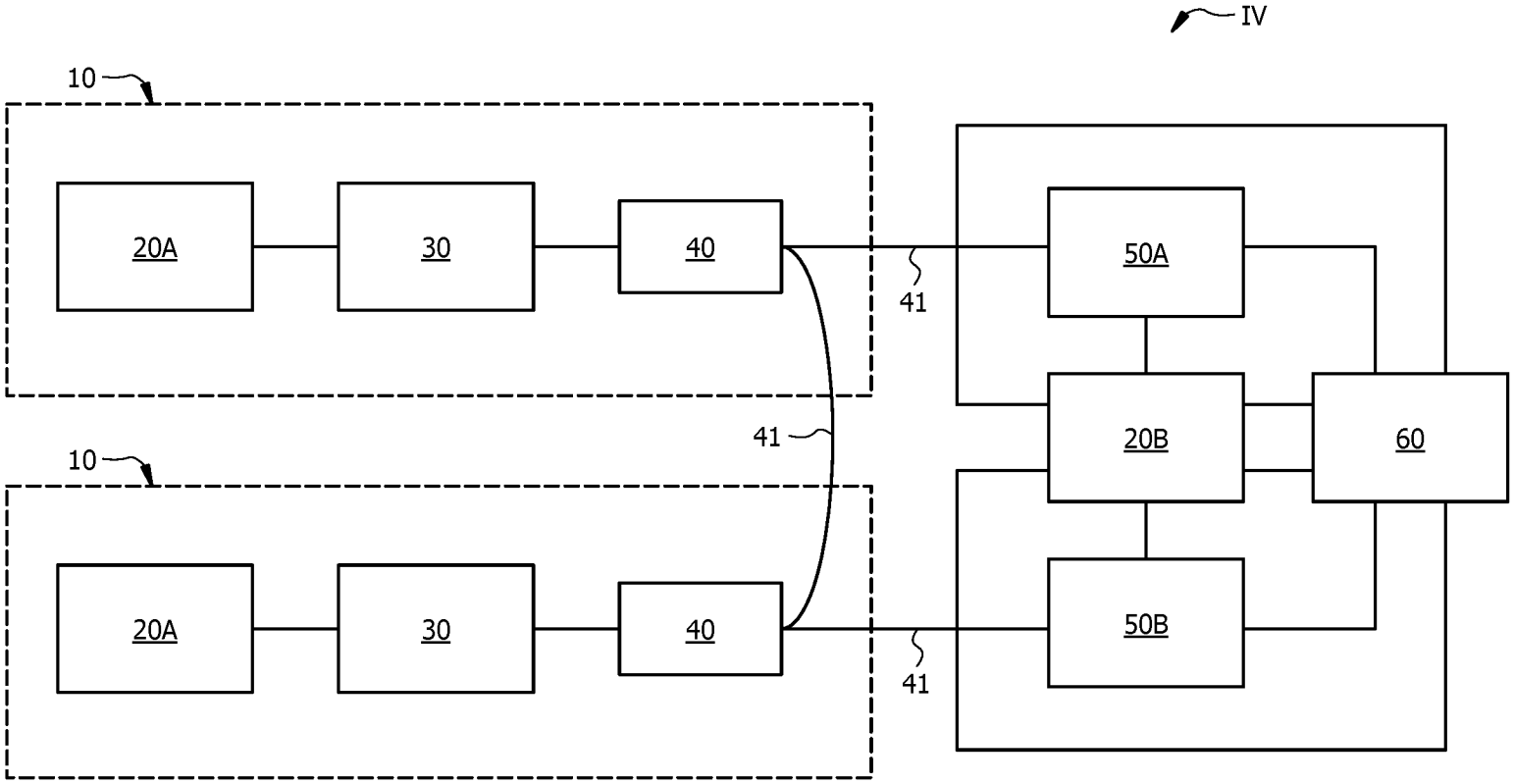
FIG. 4 is a diagram illustrating another example apparatus, according to aspects of the present disclosure.
Figure 5:
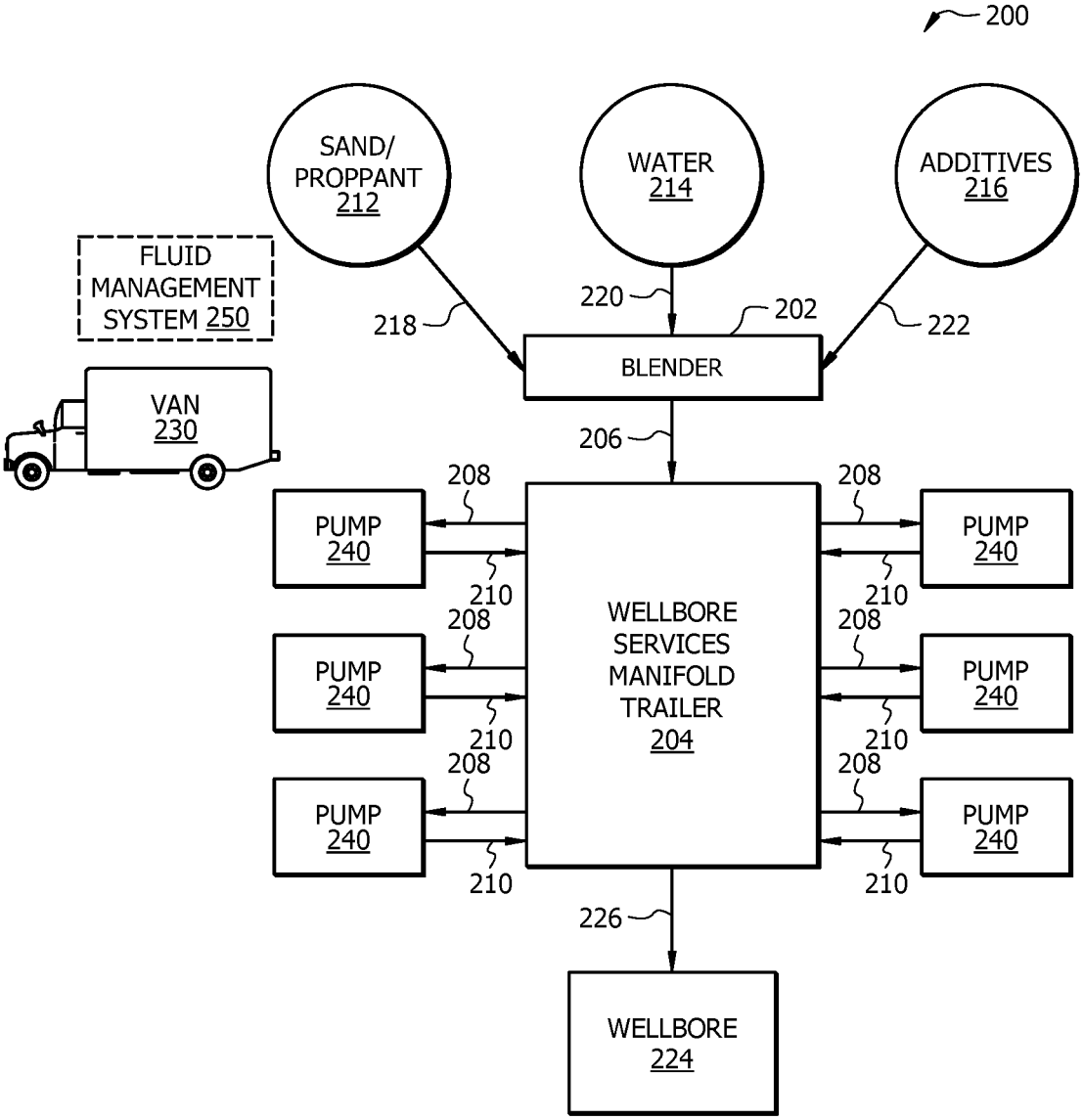
FIG. 5 is a schematic representation of an embodiment of a wellbore servicing system.

Description of the system and method will now be made with reference to the drawings in which FIG. 1 is a schematic of an example apparatus I, according to aspects of the present disclosure; FIG. 2 is a schematic of another example apparatus II, according to aspects of the present disclosure; FIG. 3 is a schematic of another example apparatus III, according to aspects of the present disclosure; FIG. 4 is a schematic of another example apparatus IV, according to aspects of the present disclosure; and FIG. 5 is a schematic representation of a wellbore servicing system in which the apparatus of this disclosure (e.g., example apparatus I/II/III/IV) can be employed.

FIG. 1 is a diagram illustrating an example apparatus I, according to aspects of the present disclosure. Apparatus I comprises one or a plurality of hybrid units 10. Each hybrid unit 10 comprises: a first mover 30 for generating first mechanical energy; a hybrid unit oilfield apparatus 20A; a drivetrain 21 for providing the first mechanical energy from the first mover 30 to the hybrid unit oilfield apparatus 20A; and a second mover 40. The second mover 40 can be coupled to the drivetrain 21 and/or the first mover 30 (e.g., within the drivetrain 21). The second mover 40 can comprise an electric motor/generator, and is configured to generate and provide second mechanical energy to the hybrid unit oilfield apparatus 20A, and/or to generate power (also referred to herein as "electricity") 41. The drivetrain 21 can output the first mechanical energy and the second mechanical energy directly to the hybrid unit oilfield apparatus 20A. The combined first and second mechanical energies provide a torque sufficient to drive the hybrid unit oilfield apparatus 20A. Apparatus I further comprises a second oilfield apparatus 20B. The second oilfield apparatus 20B is at times powered at least in part by the excess power 41 generated by the second mover 40. As utilized herein, "excess" power 41 is an amount of power above any needed by second mover 40 to provide second mechanical energy to operate hybrid unit oilfield apparatus 20A.

As used herein, a mover (e.g., first mover 30, second mover 40) may comprise any device that converts energy into mechanical energy to drive hybrid unit oilfield apparatus (e.g., a pump). Example movers include, but are not limited to, electric motors, hydrocarbon-driven or steam engines, turbines, etc. The drive train 21 may be removably coupled to the first mover 30 and the hybrid unit oilfield apparatus 20A (e.g., a pump 240) through one or more drive shafts, and may comprise a transmission with one or more gears that transmits mechanical energy from the first mover 30 to the hybrid unit oilfield apparatus 20A. For instance, to the extent the hybrid unit oilfield apparatus 20A (e.g., one or more pumps 240, discussed hereinbelow with reference to FIG. 5) comprises one or more reciprocating pumps, the mechanical energy may comprise torque that drives the pump(s). The second mover 40 can be coupled (e.g., to the transmission) between the transmission and the hybrid unit oilfield apparatus 20A (e.g., a pump). In the embodiment shown, the second mover 40 may receive mechanical energy from the first mover 30 (e.g., through the transmission) and provide the received mechanical energy to the hybrid unit oilfield apparatus 20A (e.g., pump 240) augmented by mechanical energy generated by the second mover 40. It should be appreciated, however, that the orientation of the second mover 40 with respect to the first mover 30, transmission, and the hybrid unit oilfield apparatus 20A is not limited to the embodiment shown. In other embodiments, the second mover 40 may be positioned between the transmission and the first mover 30, for instance, or between elements of the transmission itself. In yet other embodiments, the second mover 40 may be incorporated into the transmission as part of a hybrid transmission system through which energy from both the first mover 30 and second mover 40 can be provided to the hybrid unit oilfield apparatus 20A (e.g., pump 240).

The first mover 30 and second mover 40 can receive energy or fuel in one or more forms from sources at the wellsite. The energy or fuel can comprise, for instance, hydrocarbon-based fuel, electrical energy, hydraulic energy, thermal energy, etc. The sources of energy or fuel may comprise, for instance, on-site fuel tanks, mobile fuel tanks delivered to the site, electrical generators, hydraulic pumping systems, etc. The first mover 30 and second mover 40 may then convert the fuel or energy into mechanical energy that can be used to drive the associated hybrid unit oilfield apparatus 20A.

In embodiments, the first mover 30 can comprise an internal combustion engine such as a diesel or dual fuel (e.g., diesel and natural gas) engine and the second mover 40 can comprise an electric motor/generator. The internal combustion engine/first mover 30 can receive a source of fuel from one or more fuel tanks that may be located within the system 200 (FIG. 5) and refilled as necessary using a mobile fuel truck driven on site. In embodiments, the electric motor/generator/second mover 40 can further be electrically coupled to a source of electricity (e.g., disparate from a generator thereof), for example, through a cable. Example sources of electricity include, but are not limited to, an on-site electrical generator, a public utility grid, one or more power storage elements, solar cells, wind turbines, other power sources, or one or more combinations of any of the previously listed sources.

As noted hereinabove, electricity 41 can be produced by the generator of the second mover 40 and/or another generator (e.g., another hybrid unit 10) located at the wellsite. The generator may comprise, for instance, a gas-turbine generator or an internal combustion engine that produces electricity to be consumed or stored on site. The generator may receive and utilize natural gas from the wellbore 224 or from another wellbore in the field (i.e., "wellhead gas") to produce the electricity. A gas conditioning systems 90 may receive the gas from the wellbore 224 (FIG. 5) or another source and condition the gas for use in the generator. Example gas conditioning systems include, but are not limited to, gas separators, gas dehydrators, gas filters, etc. In other embodiments, conditioned natural gas may be transported to the wellsite for use by the generator. As with controller 25, a gas conditioning system 90 may be connected with the plurality of hybrid units 10, or each of the hybrid unit(s) 10 may have individual gas conditioning systems 90 and/or controllers 25. That is the controller 25 and/or the gas conditioning system 90 associated with hybrid unit 10 may be a component of that hybrid unit 10 or universal to more than one (e.g., all) of the hybrid units 10.

In use, the first mover 30 and second mover 40 may operate in parallel or in series to drive the hybrid unit oilfield apparatus 20A (e.g., a pump 240), with the division of power between the movers being flexible depending on the application. For instance, in a multi-stage well stimulation operation, the formation may be fractured (or otherwise stimulated) in one or more "stages," with each stage corresponding to a different location within the formation. Each "stage" may be accompanied by an "active" period during which the hybrid unit oilfield apparatus (e.g., pumps 240) are engaged and pressurized fluids are being pumped into the wellbore 224 to fracture the formation, and an "inactive" period during which the hybrid unit oilfield apparatus 20A (e.g., pumps 240) are not engaged while other ancillary operations are taking place. The transition between the "inactive" and "active" periods may be characterized by a sharp increase in torque requirement.

In an embodiment in which the first mover 30 comprises a diesel engine and the second mover 40 comprises an electric motor/generator 40, both the diesel engine and electric motor may be engaged to provide the necessary power, with the percentage contribution of each depending on the period in which the apparatus I is operating. For instance, during the "inactive" and "active" periods in which the torque requirements are relatively stable, the diesel engine (e.g., first mover 30), which operates more efficiently during low or near constant speed operations, may provide a higher percentage (or all) of the torque to the hybrid unit oilfield apparatus 20A (e.g., pump 240) than the electric motor of the electric motor/generator/second mover 40. In contrast, during transitions between "inactive" and "active" states, the electric motor may supplant the diesel engine as the primary source of torque to lighten the load on the diesel engine during these transient operations. In both cases, the electric motor can reduce the torque required by the diesel engine, which can reduce the amount of diesel fuel that must be consumed during the wellbore treatment (e.g., well stimulation) operation. It is noted that power sources can be used during continuous operation or intermittently as needed, including during transmission gear-shift events.

In addition to reducing the amount of diesel fuel needed to perform a wellbore (e.g., well stimulation) operation, the use of a first mover 30 and a second mover 40 in a hybrid unit 10 as described herein may provide flexibility with respect to the types of movers that may be used. For instance, natural gas engines, i.e., internal combustion engines that use natural gas as their only source of combustion, are typically not used in oil field environments due to their limited torque capacity. By including two movers within the hybrid unit(s) 10, the torque capacity of a natural gas engine (e.g., a natural gas engine first mover 30) may be augmented to allow the use of a natural gas engine within the hybrid unit 10. For instance, in certain embodiments, the first mover 30 may comprise a natural gas engine and the second mover 40 can comprise an electric motor that operates in series or parallel with the natural gas engine of the first mover 30 to provide the necessary torque to power the hybrid unit oilfield apparatus 20A (e.g., pump 240).

In embodiments, the hybrid unit(s) 10 may be electrically coupled to a controller 25 that directs the operation of the first and second movers 30/40 of the hybrid unit(s) 10. The controller 25 may comprise, for instance, an information handling system that sends one or more control signals to the hybrid unit(s) 10 to control the speed/torque output of the first and second movers 30/40. As used herein an information handling system may comprise any system containing a processor and a memory device coupled to the processor containing a set of instructions that, when executed by the processor, cause the processor to perform certain functions. The control signals may take whatever form is necessary to communicate with the associated mover. For instance, a control signal to an electric motor may comprise an electrical control signal to a variable frequency drive coupled to the electric motor, which may receive the control signal and alter the operation of the electric motor based on the control signal. In certain embodiments, the controller 25 may also be electrically coupled to other elements of the system, such as, for example, a fluid management system 250, blender system 202, pumps 240, and gas conditioning systems 90 in order to monitor and/or control the operation of the entire system. In other embodiments, some or all of the functionality associated with the controller 25 may be located on the individual elements of the system, e.g., each of the hybrid unit(s) 10 may have individual controllers that direct the operation of the associated first and second movers 30/40.

It should be appreciated that only one example configuration is illustrated in the Figures and that other embodiments and configurations are possible, depending on the types of movers and energy or fuel. In certain embodiments, some or all of the hybrid units 10 may include the same configuration, including the same types of first mover 30 and second mover 40. The configurations of the individual hybrid unit(s) 10 and of the hybrid unit oilfield equipment 20A (e.g., pumps 240) generally can depend, for instance, on the available fuel and energy sources at the wellsite. For example, if a source of natural gas is more readily available than diesel fuel at a particular wellsite, the hybrid unit(s) 10 (e.g., pumps 240 thereof) may be configured to utilize natural gas as a source of fuel/energy for both the first movers 30 and second movers 40, which could include the use of a dual fuel or natural gas driven engine as the first mover 30 and an electric motor/generator comprising an electric motor powered by a natural-gas driven generator as the second mover 40.

In certain embodiments, excess energy 41 generated by the hybrid unit(s) 10 and optionally other elements within the system 200 may be used as an energy source for the first movers 30 and/or second movers 40 of one or more hybrid unit(s) 10, and/or oilfield apparatus 20B.

The second movers 40 of the hybrid unit(s) 10 thus comprise sources of energy for the system 200. The second movers 40 of the hybrid unit(s) 10 may be coupled to each other and to an energy storage device 60. During inactive periods, or periods with lower mechanical energy requirement by the hybrid unit oilfield apparatus 20A, the first movers 30 of the hybrid unit(s) 10 can be utilized to generate excess energy, particularly when the first movers 30 comprise diesel engines that are left idling during "inactive" periods. During those periods, some or all of the second movers 40 may function as generators, receiving the excess energy from the first movers 30 and converting that excess energy into another form of energy for immediate use by other ones of the second movers 40 within the system or for storage within the energy storage device 60. For instance, where the first movers 30 comprise diesel engines and the second movers comprise electric motors/generators 40, some or all of the electric motors/generators 40 may also function as electric generators used to generate excess electricity 41 using the excess torque generated by the diesel engines 30, and that excess electricity 41 may be consumed by other ones of the electric motors 40 to immediately reduce the fuel consumption of the associated diesel engines 30 and/or the excess energy can be stored in the energy storage device(s) 60 for later use.

Although described herein as second movers 40 comprising electric motors/generators 40, it is also envisioned that, in embodiments, the first movers 30 can comprise combustion (e.g., diesel) engines and the second movers 40 can comprise hydraulic motors driven by pressurized hydraulic fluids, some or all of the hydraulic motors may use excess torque generated by the combustion (e.g., diesel) engines 40 to pressurize the hydraulic fluids for use by other ones of the hydraulic motors within the system 200 (e.g., hydraulic motors of other hybrid units 10 or of a second oilfield apparatus 20B) and/or for storage within the energy storage device 60 in the form of pressurized tank of hydraulic fluid. Other configurations are possible within the scope of this disclosure.

The hybrid unit(s) 10 can be utilized to increase the load on the engines (e.g., first movers 30) when the apparatus I/II/III/IV is operating in cold ambient temperatures. The increased load may help to raise the exhaust temperatures of the engines during cold weather. This may enable heat sensitive aftertreatment emission devices to operate more efficiently and reliably, with less clogging of those systems as experienced during light loading of the engine with low exhaust temperatures. The excess motive energy output from the hybrid unit(s) 10 during this cold weather operation may be converted into another form of energy (e.g., electricity) via the second movers 40 for immediate use by one of the other second movers 40 of another hybrid unit 10 (or a second oilfield apparatus 20B that is not a component of a hybrid unit 10) or for storage in the energy storage device 60 for later use.

As noted hereinabove, in embodiments, the first mover 30 can comprise an internal combustion engine In embodiments, the first mover 30 comprises a diesel engine, a dual fuel engine, a spark-ignited natural gas engine, or a hydrogen engine. The first mover 30 can be coupled between the second mover 40 and the hybrid unit oilfield equipment 20A or the second mover 40 can be coupled between the first mover 30 and the hybrid unit oilfield equipment 20A.

The drivetrain 21 can comprise a hybrid transmission into which the second mover 40 is integrated.

Apparatus I can further comprise a trailer 70 onto which the first mover 30, the hybrid unit oilfield equipment 20A, the drivetrain 21, and the second mover 40 are mounted; and a truck 80 coupled to the trailer 70, wherein the second mover 40 can be coupled to and receive energy from the truck 80. A trailer can be as described in U.S. patent application Ser. No. 17/738,946 or 17/738,995, the disclosure of each of which is hereby incorporated herein for purposes not contrary to this disclosure.

The drivetrain 21 can provide the first mechanical energy and the second mechanical energy (e.g., added together) to the hybrid unit oilfield equipment 20A.

As depicted in and discussed further hereinbelow with reference to FIG. 5, in embodiments, the hybrid unit oilfield apparatus 20A comprises one or more well stimulation pumps 240 comprising a reciprocating pump(s) 240, or an auxiliary apparatus selected from a blender 202, a wellbore services manifold trailer 204, a conveyor 218/220/222, a datavan 230, or a combination thereof. In embodiments, the hybrid unit oilfield apparatus 20A comprises one of the auxiliary apparatus. In some such embodiments, the second oilfield apparatus 20B comprises a pump 240 (e.g., a well stimulation pump comprising a reciprocating pump).

The apparatus of this disclosure can comprise a plurality of hybrid units 10, wherein the hybrid unit oilfield apparatus 20A of each of the hybrid units 10 can be a same or different oilfield apparatus 20A. The second mover 40 of each of the hybrid units 10 can be operable to at times provide excess power 41 utilized to drive the second oilfield apparatus 20B (e.g., which can be a hybrid unit oilfield apparatus 20A of another hybrid unit 10, or an oilfield apparatus 20B that is not a component of a hybrid unit 10). In embodiments, the second oilfield apparatus 20B is also a component of a hybrid unit 10.

With reference to FIG. 2, which is a diagram illustrating another example apparatus II, according to aspects of the present disclosure, an apparatus of this disclosure can comprise two hybrid units 10 (e.g., a first hybrid unit 10 and a second hybrid unit 10'), and the second oilfield apparatus 20B can be another hybrid oilfield apparatus 20A/20B of another hybrid unit 10' comprising another first mover 30 for generating first mechanical energy; the second oilfield apparatus 20A/20B; another drivetrain 21 for providing the first mechanical energy from the first mover of the second hybrid unit to the second oilfield apparatus 20B; and a second mover 40 within the another drivetrain 21. Like the hybrid unit 10, the another hybrid unit 10' can comprise a second mover 40 that comprises another electric motor/generator, configured to generate and provide second mechanical energy to the second oilfield apparatus 20A/20B, and/or to generate power 41. The another drivetrain 21 of the another hybrid unit 10' outputs the first mechanical energy and the second mechanical energy of the another hybrid unit 10' directly to the second oilfield apparatus 20A/20B, and the combined first and second mechanical energies of the another hybrid unit 10' provides a torque sufficient to drive the second oilfield apparatus 20A/20B. The another first mover 30 of the another hybrid unit 10' can comprise an internal combustion engine.

With reference again to the embodiment of FIG. 1, the electric motor/generator 40 of each of the one or the plurality of hybrid units 10 can be connected with an energy storage apparatus 60 configured for storing electricity 41 produced by the electric motor/generator 40 thereof. The storage apparatus 60 can be electrically connected with the second oilfield apparatus 20B, such that the second oilfield apparatus 20B can be driven at least in part using electricity 41 from the energy storage apparatus 60.

The one or more energy storage devices 60 can receive energy generated by the generators of the hybrid unit(s) 10 and/or other on-site energy sources and store in one or more forms for later use. For instance, the storage devices 60 may store the electrical energy as electrical, chemical, or mechanical energy, or in any other suitable form. Example storage devices 60 include, but are not limited to, capacitor banks, batteries, flywheels, pressure tanks, etc. In certain embodiments, the energy storage devices 60 can be incorporated into a power grid located on site through which at least some of the fluid management system 250, blender system 202, pump systems 240, and gas conditioning systems 90 may receive power.

The apparatus I/II/III/IV of this disclosure can further comprise synchronization apparatus 50 configured to synchronize electricity 41 from the electric motor/generators 40 of each of the one or the plurality of hybrid units 10 prior to storage in the energy storage apparatus 60, prior to use driving the second oilfield apparatus 20B, and/or subsequent storage in the energy storage apparatus 60 and prior to use driving the second oilfield apparatus 20B.

With reference to FIG. 3, which is a diagram illustrating another example apparatus III, according to aspects of the present disclosure, in embodiments, the second oilfield apparatus 20B can be coupled with an electric motor 30B, and the second mover 40 of the one or the plurality of hybrid units 10 (with one shown in FIG. 3) can be electrically connected with the electric motor 30B, whereby excess power 41 produced by the second mover 40 can be utilized to power the electric motor 30B.

FIG. 4 is a diagram illustrating another example apparatus IV, according to aspects of the present disclosure. The apparatus of this disclosure can comprise any number of hybrid units 10, for example, 1, 2, 3, 4, 5, 6, 7, 8, 9, 10, or more hybrid units 10. Apparatus IV of the embodiment of FIG. 4 comprises two hybrid units 10. Each hybrid unit 10 comprises a first mover 30 for generating first mechanical energy, wherein the first mover can comprise an internal combustion engine; a hybrid unit oilfield apparatus 20A; a drivetrain 21 for providing the first mechanical energy from the first mover 30 to the hybrid unit oilfield apparatus 20A; and a second mover 40 (e.g., coupled to the drivetrain 21 and/or the first mover 30 (e.g., within the drivetrain 21)). The second mover 40 comprises an electric motor/generator, and is configured to generate and provide second mechanical energy to the hybrid unit oilfield apparatus 20A, and/or to generate excess power/electricity 41. The drivetrain 21 can output the first mechanical energy and the second mechanical energy (e.g., directly) to the hybrid unit oilfield apparatus 20A, and the combined first and second mechanical energies provide a torque sufficient to drive the hybrid unit oilfield apparatus 20A. The hybrid units 10 can be electrically connected, such that electricity 41 produced in the generator of a hybrid unit 10 can be introduced into another electric motor/generator 40 of another hybrid unit 10 wherein the electric motor/generator of the another hybrid unit 10 can be, at least at times, powered at least in part by the excess power 41 generated by the second mover 40 of the hybrid unit 10. Alternatively or additionally, each of the hybrid units 10 can be electrically connected to a second oilfield apparatus 20B that is not a part of a hybrid unit 10, wherein the second oilfield apparatus 20B is at times powered at least in part by the excess power 41 generated by the second mover 40. As noted hereinabove, the first movers 10 can comprise an internal combustion engine. As depicted in FIG. 4, each of the hybrid units 10 can be electrically connected with a synchronization apparatus 50 configured to synchronize the electricity 41 for downstream use, either before or after use or storage in energy storage apparatus 60. One or more synchronization units 50 can be employed, with two synchronization units, including synchronization unit 50A and synchronization unit 50B depicted in the embodiment of FIG. 4.

The excess power 41 from the one or the plurality of hybrid units 10 can thus either be utilized directly to power a second mover 40 of another hybrid unit 10, and/or to power a second oilfield apparatus 20B, the excess power 41 can be synchronized in synchronization apparatus 50A/50B prior to use to power second mover 40 of another hybrid unit 10, and/or to power a second oilfield apparatus 20B, or the excess power 41 can be stored in energy storage apparatus 60 (before or after synchronization or without) prior to use to power second mover 40 of another hybrid unit 10, and/or to power a second oilfield apparatus 20B.

FIG. 5 is a schematic representation of an embodiment of a wellbore servicing system 200 of this disclosure. A system of this disclosure can comprise one or a plurality of pumps 240; a fluid manifold 204 providing fluid communication between each of the one or the plurality of pumps 240 and a wellbore 224; auxiliary equipment selected from a fluid management system 250, a datavan 230, a blender unit 202 providing a source of treatment fluids to the one or the plurality of pumps 240, one or more conveyors 218/220/222 for transporting one or more components (e.g., proppant, sand 212, water 214, additives 216) of the treatment fluid to the blender 202, or another auxiliary equipment; one or a plurality of hybrid units 10; and a second oilfield apparatus 20B that is powered at least in part by the excess power 41 generated by the second mover(s) 40 of the hybrid unit(s) 10. The hybrid unit oilfield apparatus 20A of each of the one or the plurality of hybrid units 10 can comprise the auxiliary equipment and the second oilfield apparatus can comprise one or more of the one or more pumps 240. Alternatively, the hybrid unit oilfield apparatus 20A of each of the one or more hybrid units 10 can comprise a pump 240 and the second oilfield apparatus can comprise one of the auxiliary equipment. Alternatively, the hybrid unit oilfield apparatus 20A of each of the hybrid unit(s) can comprise one pump 240 of the plurality of pumps 240 and the second oilfield apparatus 20B can comprise another pump 240 of the plurality of pumps 240. Each hybrid unit 10 can be a hybrid unit 10 as described hereinabove. Each hybrid unit 10 comprises: a first mover 30 for generating first mechanical energy, wherein the first mover 30 can comprise an internal combustion engine; a hybrid unit oilfield apparatus 20A; a drivetrain 21 for providing the first mechanical energy from the first mover 30 to the hybrid unit oilfield apparatus 20A; and a second mover 40 (e.g., within the drivetrain), wherein the second mover 40 can comprise an electric motor/generator, and can be configured to generate and provide second mechanical energy to the hybrid unit oilfield apparatus 20A, and to, at times, generate excess power 41, wherein the drivetrain 21 outputs the first mechanical energy and the second mechanical energy directly to the hybrid unit oilfield apparatus 20A, the combined first and second mechanical energies providing a torque sufficient to drive the hybrid unit oilfield apparatus 20A.

In embodiments, the one pump 240 can be the hybrid unit oilfield apparatus 20A of a first of the plurality of hybrid units 10, and the another pump 240 can be the hybrid unit oilfield apparatus 20A of another hybrid unit 10 of the plurality of hybrid units 10.

The apparatus I/II/III/IV can further comprise an energy storage device 60 to store the excess power and/or provide stored excess power to the second oilfield apparatus 20B. The system can further comprise a synchronization device 50/50A/50B connected with the second mover 40 and to the energy storage device 60 and configured for synchronizing the excess power 41 prior to or subsequent storage in the energy storage device 60.

Also disclosed herein is a method comprising: with each of one or a plurality of hybrid units 10: generating first mechanical energy with a first mover 30 of the hybrid unit 10, which hybrid unit 10 is mechanically coupled to a hybrid unit oilfield apparatus 20A, wherein the first mover 30 can comprise an internal combustion engine; generating second mechanical energy with a second mover 40 of the hybrid unit 10, which second mover 40 is mechanically coupled to the hybrid unit oilfield apparatus 20A, wherein the second mover 40 comprises an electric motor/generator; operating the hybrid unit oilfield apparatus 20A using the first mechanical energy and the second mechanical energy; at times, producing excess power 41 with the generator of the electric motor/generator 40; and utilizing at least a portion of the excess power 41 to operate at least one other oilfield apparatus 20B.

In embodiments, a plurality of hybrid units 10 are employed, and the second oilfield apparatus 20B can be operated entirely via the excess power 41 produced via the generators of the electric motor/generators (e.g., the second movers) 40 of the plurality of hybrid units 10.

As noted above, in embodiments, the first mover 30 comprises a diesel engine, a dual fuel engine, a spark-ignited natural gas engine, or a hydrogen engine. The second oilfield apparatus 20B can be operatively connected with a second oilfield apparatus prime mover 30/30B, wherein the second oilfield apparatus prime mover 30/30B can comprise an electric motor, and wherein the electric motor/generator 40 of the one or the plurality of hybrid units 10 is connected to the electric motor 30B, whereby the excess power 41 from the one or the plurality of hybrid units 10 can power the electric motor of the second oilfield apparatus prime mover 30/30B.

In embodiments, generating second mechanical energy with the second mover 40 comprises receiving electricity 41 from an energy storage device 60 coupled to the second mover 40. In embodiments, the at least one other oilfield apparatus 20B is the hybrid unit oilfield apparatus 20A of another of the plurality of hybrid units 10, whereby excess power 41 from the plurality of hybrid units 10 can be distributed among the plurality of hybrid units 10 to operate the hybrid unit oilfield apparatus 20A thereof.

The method can further comprise synchronizing and/or storing the excess power 41 from one or more of the plurality of hybrid units 10, for example, via synchronization apparatus 50/50A/50B.

System 200 can be operable for treatment operations, according to aspects of the present disclosure. The system 200 can include a fluid management system 250 in fluid communication with a blender system 120 or blender system 202. The blender system 202 may in turn be in fluid communication with one or more pumps or pump systems 240 through a fluid manifold system 204. The fluid manifold system 204 may provide fluid communication between the pump systems 240 and a wellbore 224. In use, the fluid management system 250 may receive water or another fluid from a fluid source 214 (e.g., a ground water source, a pond, one or more frac tanks), mix one or more fluid additives 216 and/or sand/proppant 212 into the received water or fluid to produce a treatment fluid with a desired fluid characteristic, and provide the produced treatment fluid to the blender system 202. The blender system 202 may produce the wellbore treatment fluid 206 provided via the fluid management system 250, which final treatment fluid 206 can be directed to the fluid manifold 204. The pump systems 240 may then pressurize the final treatment fluid to generate pressurized final treatment fluid that is directed into the wellbore 224, where the pressurized final treatment fluid generates fractures within a formation in fluid communication with the wellbore 224.

In embodiments, the hybrid oilfield apparatus 20A and/or the second oilfield apparatus 20B comprises a pump 240, and the method can further comprise operating the pump(s) 240 to place a wellbore servicing fluid in a wellbore 224. The wellbore servicing fluid can comprise a fracturing fluid, a cementitious fluid, a remedial fluid, a perforating fluid, a sealant, a drilling fluid, a spacer fluid, a completion fluid, a gravel pack fluid, a diverter fluid, a gelation fluid, a polymeric fluid, an aqueous fluid, an oleaginous fluid, or a combination thereof.

It will be appreciated that the wellbore servicing system 200 disclosed herein can be used for any purpose. In embodiments, the wellbore servicing system 200 may be used to service a wellbore 224 that penetrates a subterranean formation by pumping a wellbore servicing fluid into the wellbore and/or subterranean formation. As used herein, a "wellbore servicing fluid" or "servicing fluid" refers to a fluid used to drill, complete, work over, fracture, repair, or in any way prepare a well bore for the recovery of materials residing in a subterranean formation penetrated by the well bore. It is to be understood that "subterranean formation" encompasses both areas below exposed earth and areas below earth covered by water such as ocean or fresh water. Examples of servicing fluids suitable for use as the wellbore servicing fluid, the another wellbore servicing fluid, or both include, but are not limited to, cementitious fluids (e.g., cement slurries), drilling fluids or muds, spacer fluids, fracturing fluids or completion fluids, and gravel pack fluids, remedial fluids, perforating fluids, sealants, drilling fluids, completion fluids, diverter fluids, gelation fluids, polymeric fluids, aqueous fluids, oleaginous fluids, etc.

In embodiments, the wellbore servicing system 200 comprises one or more pumps 240 operable to perform oilfield and/or well servicing operations. Such operations may include, but are not limited to, drilling operations, fracturing operations, perforating operations, fluid loss operations, primary cementing operations, secondary or remedial cementing operations, or any combination of operations thereof. Although a wellbore servicing system is illustrated, skilled artisans will readily appreciate that the pump 240 disclosed herein may be employed in any suitable operation.

In embodiments, the wellbore servicing system 200 may be a system such as a fracturing spread for fracturing wells in a hydrocarbon-containing reservoir. In fracturing operations, wellbore servicing fluids, such as particle laden fluids, are pumped at high-pressure into a wellbore. The particle laden fluids may then be introduced into a portion of a subterranean formation at a sufficient pressure and velocity to cut a casing and/or create perforation tunnels and fractures within the subterranean formation. Proppants, such as grains of sand, are mixed with the wellbore servicing fluid to keep the fractures open so that hydrocarbons may be produced from the subterranean formation and flow into the wellbore. Hydraulic fracturing may desirably create high-conductivity fluid communication between the wellbore and the subterranean formation.

The wellbore servicing system 200 comprises a blender 202 that is coupled to a wellbore services manifold trailer 204 via flowline 206. As used herein, the term "wellbore services manifold trailer" includes a truck and/or trailer comprising one or more manifolds for receiving, organizing, and/or distributing wellbore servicing fluids during wellbore servicing operations. In this embodiment, the wellbore services manifold trailer 204 is coupled to six positive displacement pumps (e.g., such as pump 240 that may be mounted to a trailer and transported to the wellsite via a semi-tractor) via outlet flowlines 208 and inlet flowlines 210. In alternative embodiments, however, there may be more or less pumps used in a wellbore servicing operation. Outlet flowlines 208 are outlet lines from the wellbore services manifold trailer 204 that supply fluid to the pumps 240. Inlet flowlines 210 are inlet lines from the pumps 240 that supply fluid to the wellbore services manifold trailer 204.

The blender 202 mixes solid and fluid components to achieve a well-blended wellbore servicing fluid. As depicted, sand or proppant 212, water 214, and additives 216 are fed into the blender 202 via feedlines or conveyors 218, 220, and 222, respectively. The water 214 may be potable, non-potable, untreated, partially treated, or treated water. In embodiments, the water 214 may be produced water that has been extracted from the wellbore while producing hydrocarbons form the wellbore. The produced water may comprise dissolved and/or entrained organic materials, salts, minerals, paraffins, aromatics, resins, asphaltenes, and/or other natural or synthetic constituents that are displaced from a hydrocarbon formation during the production of the hydrocarbons. In embodiments, the water 214 may be flowback water that has previously been introduced into the wellbore during wellbore servicing operation. The flowback water may comprise some hydrocarbons, gelling agents, friction reducers, surfactants and/or remnants of wellbore servicing fluids previously introduced into the wellbore during wellbore servicing operations.

The water 214 may further comprise local surface water contained in natural and/or manmade water features (such as ditches, ponds, rivers, lakes, oceans, etc.). Still further, the water 214 may comprise water stored in local or remote containers. The water 214 may be water that originated from near the wellbore and/or may be water that has been transported to an area near the wellbore from any distance. In some embodiments, the water 214 may comprise any combination of produced water, flowback water, local surface water, and/or container stored water. In some implementations, water may be substituted by nitrogen or carbon dioxide; some in a foaming condition.

In embodiments, the blender 202 may be an Advanced Dry Polymer (ADP) blender and the additives 216 are dry blended and dry fed into the blender 202. In alternative embodiments, however, additives may be pre-blended with water using other suitable blenders, such as, but not limited to, a GEL PRO blender, which is a commercially available preblender trailer from Halliburton Energy Services, Inc., to form a liquid gel concentrate that may be fed into the blender 202. The mixing conditions of the blender 202, including time period, agitation method, pressure, and temperature of the blender 202, may be chosen by one of ordinary skill in the art with the aid of this disclosure to produce a homogeneous blend having a desirable composition, density, and viscosity. In alternative embodiments, however, sand or proppant, water, and additives may be premixed and/or stored in a storage tank before entering a wellbore services manifold trailer 204.

In embodiments, the pump(s) 240 pressurize the wellbore servicing fluid to a pressure suitable for delivery into a wellbore 224 or wellhead. For example, the pumps 240 may increase the pressure of the wellbore servicing fluid (e.g., the wellbore servicing fluid and/or the another wellbore servicing fluid) to a pressure of greater than or equal to about 10,000 psi, 20,000 psi, 30,000 psi, 40,000 psi, or 50,000 psi, or higher.

From the pumps 240, the wellbore servicing fluid may reenter the wellbore services manifold trailer 204 via inlet flowlines 210 and be combined so that the wellbore servicing fluid may have a total fluid flow rate that exits from the wellbore services manifold trailer 204 through flowline 226 to the flow connector wellbore 1128 of between about 1 BPM to about 200 BPM, alternatively from between about 50 BPM to about 150 BPM, alternatively about 100 BPM. in embodiments, each of one or more pumps 240 discharge wellbore servicing fluid at a fluid flow rate of between about 1 BPM to about 200 BPM, alternatively from between about 50 BPM to about 150 BPM, alternatively about 100 BPM. Persons of ordinary skill in the art with the aid of this disclosure will appreciate that the flowlines described herein are piping that are connected together for example via flanges, collars, welds, etc. These flowlines may include various configurations of pipe tees, elbows, and the like. These flowlines connect together the various wellbore servicing fluid process equipment described herein.

Also disclosed herein are methods for servicing a wellbore (e.g., wellbore 224). Without limitation, servicing the wellbore may include: positioning the wellbore servicing composition in the wellbore 224 (e.g., via one or more pumps 240 as described herein) to isolate the subterranean formation from a portion of the wellbore; to support a conduit in the wellbore; to plug a void or crack in the conduit; to plug a void or crack in a cement sheath disposed in an annulus of the wellbore; to plug a perforation; to plug an opening between the cement sheath and the conduit; to prevent the loss of aqueous or nonaqueous drilling fluids into loss circulation zones such as a void, vugular zone, or fracture; to plug a well for abandonment purposes; to divert treatment fluids; and/or to seal an annulus between the wellbore and an expandable pipe or pipe string. In other embodiments, the wellbore servicing systems and methods may be employed in well completion operations such as primary and secondary cementing operation to isolate the subterranean formation from a different portion of the wellbore.

In embodiments, a wellbore servicing method may comprise transporting a positive displacement pump (e.g., pump 240) to a site for performing a servicing operation. Additionally or alternatively, one or more pumps may be situated on a suitable structural support. Non-limiting examples of a suitable structural support or supports include a trailer, truck, skid, barge or combinations thereof. In embodiments, a motor or other power source for a pump may be situated on a common structural support.

In embodiments, a wellbore servicing method may comprise providing a source for a wellbore servicing fluid. As described above, the wellbore servicing fluid may comprise any suitable fluid or combinations of fluid as may be appropriate based upon the servicing operation being performed. Non-limiting examples of suitable wellbore servicing fluid include a fracturing fluid (e.g., a particle laden fluid, as described herein), a perforating fluid, a cementitious fluid, a sealant, a remedial fluid, a drilling fluid (e.g., mud), a spacer fluid, a gravel pack fluid, a diverter fluid, a gelation fluid, a polymeric fluid, an aqueous fluid, an oleaginous fluid, an emulsion, various other wellbore servicing fluid as will be appreciated by one of skill in the art with the aid of this disclosure, and combinations thereof. The wellbore servicing fluid may be prepared on-site (e.g., via the operation of one or more blenders) or, alternatively, transported to the site of the servicing operation.

In embodiments, a wellbore servicing method may comprise fluidly coupling a pump 240 to the wellbore servicing fluid source. As such, wellbore servicing fluid may be drawn into and emitted from the pump 240. Additionally or alternatively, a portion of a wellbore servicing fluid placed in a wellbore 224 may be recycled, i.e., mixed with the water stream obtained from a water source and treated in fluid treatment system. Furthermore, a wellbore servicing method may comprise conveying the wellbore servicing fluid from its source to the wellbore via the operation of the pump 240 disclosed herein.

In alternative embodiments, the reciprocating apparatus may comprise a compressor. In embodiments, a compressor similar to the pump 240 may comprise at least one each of a cylinder, plunger, connecting rod, crankshaft, and housing, and may be coupled to a motor. In embodiments, such a compressor may be similar in form to a pump and may be configured to compress a compressible fluid (e.g., a gas) and thereby increase the pressure of the compressible fluid. For example, a compressor may be configured to direct the discharge therefrom to a chamber or vessel that collects the compressible fluid from the discharge of the compressor until a predetermined pressure is built up in the chamber. Generally, a pressure sensing device may be arranged and configured to monitor the pressure as it builds up in the chamber and to interact with the compressor when a predetermined pressure is reached. At that point, the compressor may either be shut off, or alternatively the discharge may be directed to another chamber for continued operation.

In embodiments, a reciprocating apparatus comprises an internal combustion engine, hereinafter referred to as an engine. Such engines are also well known, and typically include at least one each of a plunger, cylinder, connecting rod, and crankshaft. The arrangement of these components is substantially the same in an engine and a pump (e.g. pump 240). A reciprocating element 18 such as a plunger may be similarly arranged to move in reciprocating fashion within the cylinder. Skilled artisans will appreciate that operation of an engine may somewhat differ from that of a pump. In a pump, rotational power is generally applied to a crankshaft acting on the plunger via the connecting rod, whereas in an engine, rotational power generally results from a force (e.g., an internal combustion) exerted on or against the plunger, which acts against the crankshaft via the connecting rod.

For example, in a typical 4-stroke engine, arbitrarily beginning with the exhaust stroke, the plunger is fully extended during the exhaust stroke, (e.g., minimizing the internal volume of the cylinder). The plunger may then be retracted by inertia or other forces of the engine componentry during the intake stroke. As the plunger retracts within the cylinder, the internal volume of cylinder increases, creating a low pressure within the cylinder into which an air/fuel mixture is drawn. When the plunger is fully retracted within the cylinder, the intake stroke is complete, and the cylinder is substantially filled with the air/fuel mixture. As the crankshaft continues to rotate, the plunger may then be extended, during the compression stroke, into the cylinder compressing the air-fuel mixture within the cylinder to a higher pressure.

A spark plug may be provided to ignite the fuel at a predetermined point in the compression stroke. This ignition increases the temperature and pressure within the cylinder substantially and rapidly. In a diesel engine, however, the spark plug may be omitted, as the heat of compression derived from the high compression ratios associated with diesel engines suffices to provide spontaneous combustion of the air-fuel mixture. In either case, the heat and pressure act forcibly against the plunger and cause it to retract back into the cylinder during the power cycle at a substantial force, which may then be exerted on the connecting rod, and thereby on to the crankshaft.

Those of ordinary skill in the art will readily appreciate various benefits that may be realized by the present disclosure. Some powertrains, particularly spark ignited natural gas engines, need assistance, at times, to produce sufficient torque for well servicing applications. To solve for this, a hybrid drive configuration, such as comprising a natural gas engine assisted by an electric motor coupled to the power train, can be utilized to help ensure the necessary torque in all modes of operation. The attached electric motor of an electric motor/generator (e.g., of second mover 40) can also be utilized as a generator for times when the required torque is low for well servicing but it is still more efficient to run the primary engine 30 closer to full load. Other equipment on location can then be powered by the excess energy 41.

According to this disclosure, excess energy 41 generated from a hybrid powertrain (primary engine 30 and secondary drive/generator 40) can be utilized to supply power to other pieces of equipment (e.g., a second oilfield apparatus 20B, an electric motor of an electric motor/generator 40 of another hybrid unit 10) in the system. Excess energy 41 can be generated on one hybrid (e.g., pumping) unit 10 and distributed to other hybrid (e.g., pumping) unit(s) 10, blending equipment 202, data vans 230, or other auxiliary equipment. In embodiments, the hybrid units 10 comprise pumps 240 as hybrid unit oilfield apparatus 20A. Alternatively or additionally, excess energy 41 can be generated from blending equipment 202 or other auxiliary equipment and that excess power 41 distributed elsewhere in the system (e.g., to the pumping units 240).

The herein disclosed apparatus, systems, and methods provide a combination of a hybrid powertrain (e.g., hybrid unit(s) 10) with power generation and ability to distribute the excess power 41 elsewhere in the spread. The disclosed apparatus, systems, and methods can allow for increased overall efficiency of operations, by enabling the engine/first mover 30 to run higher up on the curve and be more efficient.

A hybrid unit 10 of this disclosure comprises a prime mover 30 and electric motor comprising second mover 40 included in the power train (hybrid arrangement). The electric motor 40 can either provide assistance to the first prime mover 30 during times of peak torque or generate power 41 during times of low demand and provide that power 41 to other units (e.g., other hybrid unit(s) 10 and/or other/second oilfield apparatus 20B) in the spread. In embodiments, excess power 41 can be generated on a first pump truck and that power 41 can be distributed to blending 202, sand conveyance 218, data vans 230, or other auxiliary equipment. In embodiments, excess power 41 from several hybrid unit(s) 10 (e.g., several hybrid unit 10 pump 240 trucks) can be combined such that the auxiliary equipment (e.g., for the entire spread) can potentially be powered via this "excess energy" 41. Power 41 could be consumed real time or stored in a battery system (e.g., energy storage apparatus 60) for future consumption. Alternatively the auxiliary equipment (blenders 202, sand or other conveyors 218/220/222, data vans 230, etc.) can be built as a hybrid unit(s) 10 with a prime mover 30 and electric motor/generator as second mover 40. In such embodiments, the electric motor of the second mover 40 can be used to generate power 41 and distribute it to individual pumping trailer 204 or elsewhere in the (e.g., entire) spread. Since auxiliary equipment typically is operated at fixed speeds and doesn't regularly operate high on the engine curves it may be particularly attractive to generate the excess energy 41 with auxiliary equipment and distribute it to pumping trailers (e.g., pumps 240) to help with peak shaving or time of high load.

The herein disclosed apparatus, system, and method provide the ability to draw power 41 both to and from low pressure/auxiliary equipment, in embodiments.

Although the present disclosure and its advantages have been described in detail, it should be understood that various changes, substitutions and alterations can be made herein without departing from the spirit and scope of the disclosure as defined by the following claims.

Additional Disclosure

The following enumerated aspects of the present disclosure are provided as non-limiting examples.

In a first embodiment, an apparatus, comprises: one or a plurality of hybrid units, each hybrid unit comprising: a first mover for generating first mechanical energy, wherein the first mover comprises an internal combustion engine; a hybrid unit oilfield apparatus; a drivetrain for providing the first mechanical energy from the first mover to the hybrid unit oilfield apparatus; and a second mover, wherein the second mover comprises an electric motor/generator, and is configured to generate and provide second mechanical energy to the hybrid unit oilfield apparatus, and/or to generate power, wherein the drivetrain outputs the first mechanical energy and the second mechanical energy directly to the hybrid unit oilfield apparatus, the combined first and second mechanical energies providing a torque sufficient to drive the hybrid unit oilfield apparatus.

A second embodiment can include the apparatus of the first embodiment, further comprising a second oilfield apparatus, wherein the second oilfield apparatus is at times powered at least in part by excess power generated by the second mover.

A third embodiment can include the apparatus of the first or second embodiment, wherein the first mover comprises a diesel engine, a dual fuel engine, a spark-ignited natural gas engine, or a hydrogen engine.

A fourth embodiment can include the apparatus of any one of the first to third embodiments, wherein the first mover is coupled between the second mover and the hybrid unit oilfield apparatus or wherein the second mover is coupled between the first mover and the hybrid unit oilfield apparatus.

A fifth embodiment can include the apparatus of any one of the first to fourth embodiments, wherein the drivetrain comprises a hybrid transmission into which the second mover is integrated.

A sixth embodiment can include the apparatus of any one of the first to fifth embodiments, further comprising a trailer onto which the first mover, the hybrid unit oilfield apparatus, the drivetrain, the second mover, or a combination thereof are mounted; and a truck coupled to the trailer, wherein the second mover is coupled to and receives energy from the truck.

A seventh embodiment can include the apparatus of any one of the first to sixth embodiments, wherein the drivetrain provides the first mechanical energy and the second mechanical energy added together to the hybrid unit oilfield equipment.

An eighth embodiment can include the apparatus of any one of the first to sixth embodiments, wherein the hybrid unit oilfield apparatus comprises a well stimulation pump comprising a reciprocating pump, or an auxiliary apparatus selected from a blender, a wellbore services manifold trailer, a conveyor, a datavan or a combination thereof.

A ninth embodiment can include the apparatus of the eighth embodiment, wherein the hybrid unit oilfield apparatus comprises the auxiliary apparatus.

A tenth embodiment can include the apparatus of any one of the first to ninth embodiments, wherein the second oilfield apparatus comprises a well stimulation pump comprising a reciprocating pump.

An eleventh embodiment can include the apparatus of any one of the first to tenth embodiments, wherein the hybrid unit oilfield apparatus comprises the well stimulation pump, and wherein the second oilfield apparatus is another hybrid oilfield apparatus of another hybrid unit comprising another first mover for generating first mechanical energy, wherein the another first mover comprises an internal combustion engine; the second oilfield apparatus; another drivetrain for providing the first mechanical energy from the first mover of the second hybrid unit to the second oilfield apparatus; and a second mover within the another drivetrain, wherein the second mover comprises another electric motor/generator, and is configured to generate and provide second mechanical energy to the second oilfield apparatus, and/or to generate power; wherein the another drivetrain outputs the first mechanical energy and the second mechanical energy of the another hybrid unit directly to the second oilfield apparatus, the combined first and second mechanical energies of the another hybrid unit providing a torque sufficient to drive the second oilfield apparatus.

A twelfth embodiment can include the apparatus of any one of the first to eleventh embodiments, comprising a plurality of hybrid units, wherein the hybrid unit oilfield apparatus of each of the hybrid units is a same or different oilfield apparatus, and wherein the second mover of each of the hybrid units is operable to at times provide excess power utilized to drive the second oilfield apparatus, a hybrid unit oilfield apparatus of another of the plurality of hybrid units, or a combination thereof.

A thirteenth embodiment can include the apparatus of any one of the first to twelfth embodiments, wherein the electric motor/generator of each of the one or the plurality of hybrid units is connected with a storage apparatus configured for storing electricity produced by the electric motor/generator thereof.

A fourteenth embodiment can include the apparatus of the thirteenth embodiment, wherein the storage apparatus is electrically connected with the second oilfield apparatus, such that the second oilfield apparatus can be driven at least in part using electricity from the storage apparatus.

A fifteenth embodiment can include the apparatus of any one of the first to fourteenth embodiments, further comprising synchronization apparatus configured to synchronize electricity from the electric motor/generators of each of the one or the plurality of hybrid units prior to storage in the storage apparatus, prior to use driving the second oilfield apparatus, and/or subsequent storage in the storage apparatus and prior to use driving the second oilfield apparatus.

A sixteenth embodiment can include the apparatus of any one of the first to fifteenth embodiments, wherein the second oilfield apparatus comprises a piece of oilfield equipment coupled with an electric motor, and wherein the second mover of the one or the plurality of hybrid units is electrically connected with the electric motor, whereby excess power produced by the second mover can be utilized to power the electric motor.

In a seventeenth embodiment, a system comprises: one or a plurality of pumps; a fluid manifold providing fluid communication between each of the one or the plurality of pumps and a wellbore; auxiliary equipment selected from a fluid management system, a datavan, a blender unit providing a source of treatment fluids to the one or the plurality of pumps, one or more conveyors for transporting one or more components (e.g., proppant, sand) of the treatment fluid to the blender, or another equipment; one or a plurality of hybrid units, each hybrid unit comprising: a first mover for generating first mechanical energy, wherein the first mover comprises an internal combustion engine; a hybrid unit oilfield apparatus; a drivetrain for providing the first mechanical energy from the first mover to the hybrid unit oilfield apparatus; and a second mover, wherein the second mover comprises an electric motor/generator, and is configured to generate and provide second mechanical energy to the hybrid unit oilfield apparatus, wherein the drivetrain outputs the first mechanical energy and the second mechanical energy directly to the hybrid unit oilfield apparatus, the combined first and second mechanical energies providing a torque sufficient to drive the hybrid unit oilfield apparatus.

An eighteenth embodiment can include the system of the seventeenth embodiment, wherein the one pump is the hybrid unit oilfield apparatus of a first of the plurality of hybrid units, and wherein the another pump is the hybrid unit oilfield apparatus of another hybrid unit of the plurality of hybrid units.

A nineteenth embodiment can include the system of the seventeenth or eighteenth embodiment, further comprising an energy storage device to store the excess power.

A twentieth embodiment can include the system of any one of the seventeenth to nineteenth embodiments, further comprising a synchronization device connected with the second mover and to the energy storage device and configured for synchronizing the excess power prior to or subsequent storage in the energy storage device.

A twenty first embodiment can include the system of any one of the seventeenth to twentieth embodiments, wherein the second mover is further configured to, at times, generate excess power, and optionally wherein the system further comprises second oilfield apparatus that is powered at least in part by the excess power generated by the second mover, wherein the hybrid unit oilfield apparatus comprises the auxiliary equipment and the second oilfield apparatus comprises the pump, wherein the hybrid unit oilfield apparatus comprises the pump and the second oilfield apparatus comprises the auxiliary equipment, or wherein the hybrid unit oilfield apparatus comprises one pump of the plurality of pumps and the second oilfield apparatus comprises another pump of the plurality of pumps.

In a twenty second embodiment, a method comprises: with each of one or a plurality of hybrid units: generating first mechanical energy with a first mover of the hybrid unit, which hybrid unit is mechanically coupled to a hybrid unit oilfield apparatus, wherein the first mover comprises an internal combustion engine; generating second mechanical energy with a second mover of the hybrid unit, which second mover is mechanically coupled to the hybrid unit oilfield apparatus, wherein the second mover comprises an electric motor/generator; operating the hybrid unit oilfield apparatus using the first mechanical energy and the second mechanical energy.

A twenty third embodiment can include the method of the twenty second embodiment, further comprising, at times, producing excess power with the generator of the electric motor/generator; and utilizing at least a portion of the excess power to operate at least one other oilfield apparatus.

A twenty fourth embodiment can include the method of any one of the twenty second to twenty third embodiments, comprising the plurality of hybrid units, and wherein the at least one other oilfield apparatus is operated entirely via the excess power produced via generators of the electric motor/generators of the second movers of the plurality of hybrid units.

A twenty fifth embodiment can include the method of the any one of the twenty second to twenty fourth embodiments, wherein the first mover comprises a diesel engine, a dual fuel engine, a spark-ignited natural gas engine, or a hydrogen engine.

A twenty sixth embodiment can include the method of any one of the twenty second to twenty fifth embodiments, wherein the at least one other oilfield apparatus is operatively connected with a second oilfield apparatus prime mover, wherein the second oilfield apparatus prime mover comprises an electric motor, and wherein the electric motor/generator of the one or the plurality of hybrid units is connected to the electric motor, whereby the excess power from the one or the plurality of hybrid units can power the electric motor.

A twenty seventh embodiment can include the method of any one of the twenty second to twenty sixth embodiments, wherein generating second mechanical energy with the second mover comprises receiving electricity from an energy storage device coupled to the second mover.

A twenty eighth embodiment can include the method of any one of the twenty second to twenty seventh embodiments, wherein the at least one other oilfield apparatus is the hybrid unit oilfield apparatus of another of the plurality of hybrid units, whereby excess power from the plurality of hybrid units can be distributed among the plurality of hybrid units to operate the hybrid unit oilfield apparatus thereof.

A twenty ninth embodiment can include the method of any one of the twenty second to twenty eighth embodiments, further comprising synchronizing and/or storing the excess power from one or more of the plurality of hybrid units.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, RI, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

We claim:

1. An apparatus, comprising:

one or a plurality of hybrid units, each hybrid unit comprising:

a first mover for generating a first mechanical energy, wherein the first mover comprises an internal combustion engine;

a hybrid unit oilfield apparatus;

a drivetrain for providing the first mechanical energy from the first mover to the hybrid unit oilfield apparatus; and a second mover, wherein the second mover comprises an electric motor/generator, that generates and provides a second mechanical energy to the hybrid unit oilfield apparatus and, generates electrical power, wherein the drivetrain outputs the first mechanical energy and the second mechanical energy directly to the hybrid unit oilfield apparatus, the combined first and second mechanical energies providing a torque sufficient to drive the hybrid unit oilfield apparatus, and wherein the hybrid unit oilfield apparatus of a first of the one or the plurality of hybrid units comprises a well stimulation pump comprising a reciprocating pump, and wherein an auxiliary apparatus is at least in part powered at times by excess electrical power generated by the second mover, wherein the auxiliary apparatus is selected from a blender, a wellbore services manifold trailer, a conveyor, a datavan or a combination thereof.

2. The apparatus of claim 1 comprising the plurality of hybrid units, wherein the hybrid unit oilfield apparatus of a second of the plurality of hybrid units comprises auxiliary apparatus selected from a blender, a wellbore services manifold trailer, a conveyor, a datavan or a combination thereof.

3. The apparatus of claim 1 further comprising a second oilfield apparatus, wherein the second oilfield apparatus is at times powered at least in part by excess electrical power generated by the second mover.

4. The apparatus of claim 3, further comprising a trailer onto which the first mover, the hybrid unit oilfield apparatus, the drivetrain, the second mover, or a combination thereof are mounted; and a truck coupled to the trailer, wherein the second mover is coupled to and receives energy from the truck.

5. The apparatus of claim 3, wherein the second oilfield apparatus comprises a well stimulation pump comprising a reciprocating pump.

6. The apparatus of claim 3, wherein the second oilfield apparatus is another hybrid oilfield apparatus of another hybrid unit comprising another first mover for generating first mechanical energy, wherein the another first mover comprises an internal combustion engine; the second oilfield apparatus; another drivetrain for providing the first mechanical energy from the first mover of the second hybrid unit to the second oilfield apparatus; and a second mover within the another drivetrain, wherein the second mover comprises another electric motor/generator, and generates and provides second mechanical energy to the second oilfield apparatus, generates electrical power, or a combination thereof; wherein the another drivetrain outputs the first mechanical energy and the second mechanical energy of the another hybrid unit directly to the second oilfield apparatus, the combined first and second mechanical energies of the another hybrid unit providing a torque sufficient to drive the second oilfield apparatus.

7. The apparatus of claim 3 comprising a plurality of hybrid units, wherein the hybrid unit oilfield apparatus of each of the hybrid units is a same or different oilfield apparatus, and wherein the second mover of each of the hybrid units is operable to at times provide excess electrical power utilized to drive the second oilfield apparatus, a hybrid unit oilfield apparatus of another of the plurality of hybrid units, or a combination thereof.

8. The apparatus of claim 1, wherein the electric motor/generator of each of the one or the plurality of hybrid units is connected with a storage apparatus that stores electricity produced by the electric motor/generator thereof.

9. The apparatus of claim 8, further comprising a second oilfield apparatus, wherein the second oilfield apparatus is at times powered at least in part by the excess electrical power generated by the second mover, and further comprising a synchronization apparatus that synchronizes electricity from the electric motor/generators of each of the one or the plurality of hybrid units prior to storage in the storage apparatus, prior to use driving the second oilfield apparatus, subsequent storage in the storage apparatus and prior to use driving the second oilfield apparatus, or a combination thereof.

10. The apparatus of claim 1 further comprising a second oilfield apparatus, wherein the second oilfield apparatus is at times powered at least in part by the excess electrical power generated by the second mover, wherein the second oilfield apparatus comprises a piece of oilfield equipment coupled with an electric motor, and wherein the second mover of the one or the plurality of hybrid units is electrically connected with the electric motor, whereby excess electrical power produced by the second mover can be utilized to power the electric motor.

11. The apparatus of claim 1 further comprising a trailer upon which the first mover, the hybrid unit oilfield apparatus, the drivetrain, and the second mover are mounted.

12. The apparatus of claim 1, wherein the hybrid unit oilfield apparatus is an auxiliary, non-pump, apparatus selected from a blender, a wellbore services manifold trailer, a conveyor, a datavan or a combination thereof, and wherein an excess electrical power generated by the second mover is utilized at times to at least in part power a second hybrid unit oilfield apparatus comprising a pump.

13. A system comprising:

one or a plurality of pumps;

a fluid manifold providing fluid communication between each of the one or the plurality of pumps and a wellbore; auxiliary equipment selected from a fluid management system, a datavan, a blender unit providing a source of treatment fluids to the one or the plurality of pumps, one or more conveyors for transporting one or more components of the treatment fluid to the blender unit, or another equipment;

one or a plurality of hybrid units, each hybrid unit comprising: a first mover for generating a first mechanical energy, wherein the first mover comprises an internal combustion engine; a hybrid unit oilfield apparatus; a drivetrain for providing the first mechanical energy from the first mover to the hybrid unit oilfield apparatus; and a second mover, wherein the second mover comprises an electric motor/generator, that generates and provides a second mechanical energy to the hybrid unit oilfield apparatus and generates electrical power, wherein the drivetrain outputs the first mechanical energy and the second mechanical energy directly to the hybrid unit oilfield apparatus, the combined first and second mechanical energies providing a torque sufficient to drive the hybrid unit oilfield apparatus;

wherein the hybrid unit oilfield apparatus of at least one of the one or the plurality of hybrid units comprises a well stimulation pump comprising a reciprocating pump, and wherein an auxiliary apparatus is at least in part powered at times by excess electrical power generated by the second mover, wherein the auxiliary apparatus is selected from a blender, a wellbore services manifold trailer, a conveyor, a datavan or a combination thereof.

14. The system of claim 13 wherein the system further comprises a second oilfield apparatus that is powered at least in part by the excess electrical power generated by the second mover, wherein the hybrid unit oilfield apparatus comprises auxiliary equipment and the second oilfield apparatus comprises one pump of the plurality of pumps, wherein the hybrid unit oilfield apparatus comprises the one pump of the plurality of pumps and the second oilfield apparatus comprises auxiliary equipment, or wherein the hybrid unit oilfield apparatus comprises one pump of the plurality of pumps and the second oilfield apparatus comprises another pump of the plurality of pumps.

15. The system of claim 14, further comprising an energy storage device to store the excess electrical power; a synchronization device connected with the second mover, the energy storage device, or both and that synchronizes the excess electrical power prior to or subsequent storage in the energy storage device; or both.

16. The system of claim 14, wherein the one pump is the hybrid unit oilfield apparatus of a first of the plurality of hybrid units, and wherein the another pump is the hybrid unit oilfield apparatus of another hybrid unit of the plurality of hybrid units.

17. A method comprising: with one or each of a plurality of hybrid units: generating a first mechanical energy with a first mover of the hybrid unit, which hybrid unit is mechanically coupled to a hybrid unit oilfield apparatus, wherein the first mover comprises an internal combustion engine; generating a second mechanical energy with a second mover of the hybrid unit, which second mover is mechanically coupled to the hybrid unit oilfield apparatus, wherein the second mover comprises an electric motor/generator that generates and provides a second mechanical energy to the hybrid unit oilfield apparatus and generates electrical power; operating the hybrid unit oilfield apparatus using the first mechanical energy and the second mechanical energy, and wherein the hybrid unit oilfield apparatus of at least one of the one of the plurality of hybrid units comprises a well stimulation pump comprising a reciprocating pump, and wherein the method further comprises at times powering an auxiliary apparatus at least in part by excess electrical power generated by the second mover, wherein the auxiliary apparatus is selected from a blender, a wellbore services manifold trailer, a conveyor, a datavan or a combination thereof.

18. The method of claim 17 further comprising, at times, producing excess electrical power with the generator of the electric motor/generator; and utilizing at least a portion of the excess electrical power to operate at least one other oilfield apparatus.

19. The method of claim 18, comprising the plurality of hybrid units, and wherein the at least one other oilfield apparatus is operated entirely via the excess electrical power produced via generators of the electric motor/generators of the second movers of the plurality of hybrid units; wherein the at least one other oilfield apparatus is operatively connected with a second oilfield apparatus prime mover, wherein the second oilfield apparatus prime mover comprises an electric motor, and wherein the electric motor/generator of the one or the plurality of hybrid units is connected to the electric motor, whereby the excess electrical power from the one or the plurality of hybrid units can power the electric motor; and/or wherein the at least one other oilfield apparatus is the hybrid unit oilfield apparatus of another of the plurality of hybrid units, whereby excess electrical power from the plurality of hybrid units can be distributed among the plurality of hybrid units to operate the hybrid unit oilfield apparatus thereof.

20. The method of claim 17, further comprising, at times, producing excess electrical power with the generator of the electric motor/generator; and synchronizing, storing, or synchronizing and storing the excess electrical power from one or more of the plurality of hybrid units.

* * * * *